US006969138B2

(12) United States Patent
Ikeda et al.

(10) Patent No.: US 6,969,138 B2
(45) Date of Patent: Nov. 29, 2005

(54) INK JET RECORDING APPARATUS

(75) Inventors: Kouji Ikeda, Hyogo (JP); Koichi Baba, Osaka (JP); Masaichiro Tatekawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 83 days.

(21) Appl. No.: 10/634,971

(22) Filed: Aug. 5, 2003

(65) Prior Publication Data

US 2004/0036725 A1 Feb. 26, 2004

(30) Foreign Application Priority Data

Aug. 22, 2002 (JP) ..... 2002-241970

(51) Int. Cl.[7] ..... B41J 29/38
(52) U.S. Cl. ..... 347/11
(58) Field of Search ..... 347/5–13, 37, 347/39, 73–77

(56) References Cited

U.S. PATENT DOCUMENTS 5,980,015 A * 11/1999 Saruta ..... 347/15
6,460,959 B1 * 10/2002 Momose et al. ..... 347/11
6,508,532 B1 * 1/2003 Hawkins et al. ..... 347/20
6,761,423 B2 * 7/2004 Ozaki et al. ..... 347/11

* cited by examiner

*Primary Examiner*—Hai Pham
(74) *Attorney, Agent, or Firm*—Harness, Dickey & Pierce, P.L.C.

(57) ABSTRACT

An ink jet recording apparatus includes an ink jet head, a reference pulse generation circuit, and switch circuits. The reference pulse generation circuit is a circuit for generating, at a predetermined cycle, a first reference pulse P4*a* based on which a driving pulse is produced. A preliminary pulse P1 is for vibrating an ink meniscus in the tip portion of a nozzle. A discharge pulse P2 is for discharging an ink droplet through the nozzle. The switch circuits selectively input, to piezoelectric actuators, the preliminary pulse P1 and the discharge pulse P2 generated by the reference pulse generation circuit.

37 Claims, 19 Drawing Sheets

INK JET RECORDING APPARATUS

TECHNICAL FIELD

The present invention relates to an ink jet recording apparatus.

BACKGROUND ART

Ink jet recording apparatuses that record information by using the piezoelectric effect of a piezoelectric element have been known in the art.

An ink jet recording apparatus of this type includes an ink jet head, driving signal supply means, and relative movement means. The ink jet head includes a head assembly including nozzles and pressure chambers storing ink therein and communicated to the nozzles, and piezoelectric actuators for applying a pressure on the ink in the pressure chambers so as to discharge ink droplets through the nozzles by the piezoelectric effect of piezoelectric elements. The driving signal supply means supplies a driving signal to the piezoelectric actuators. The relative movement means relatively moves the ink jet head and recording paper with respect to each other while ink droplets are being discharged from the nozzles. While the ink jet head and the recording paper are being relatively moved with respect to each other by the relative movement means, the driving signal supply means supplies the driving signal. The piezoelectric actuators are activated by the driving signal to discharge ink droplets through the nozzles. The discharged ink droplets land on the recording paper to form ink dots. A large number of ink dots on the recording paper together form an intended image on the recording paper.

When recording an image with an ink jet head in which a plurality of nozzles are arranged in the secondary scanning direction Y (the direction perpendicular to the relative movement direction), the formed ink dots may vary from one another in the diameter thereof or the landing position thereof with respect to the secondary scanning direction Y, as illustrated in FIG. 28, due to a defect of the ink jet head, etc. In such a case, white streaks 101 extending in the primary scanning direction X (the relative movement direction) appear on the recording paper, thereby lowering the image quality.

In order to solve the problem, N-pass recording has been used in the art, in which the same line is scanned N times (N is a natural number equal to or greater than two) in the primary scanning direction X. As illustrated in FIG. 29, a 2-pass recording operation, for example, is performed by forming ink dots (solid-circle ink dots), skipping every other dot position, while the ink jet head is moved in the primary scanning direction X in the first pass (the first scan) and then forming ink dots (open-circle ink dots) to fill the skipped dot positions in the second pass (the second scan). The operation is performed so that the second uppermost ink dot formed in the first pass and the uppermost ink dot formed in the second pass are next to each other in the primary scanning direction X. In this way, it is possible to prevent white streaks extending in the primary scanning direction X from appearing on the recording paper.

However, N-pass recording lowers the recording speed because of the need to scan the same line N times.

DISCLOSURE OF THE INVENTION

It is an object of the present invention to provide an ink jet recording apparatus capable of recording information on a recording medium in which white streaks extending in the relative movement direction are prevented from appearing on the recording medium while also preventing a decrease in the recording speed.

According to a first aspect of the present invention, there is provided an ink jet recording apparatus, including a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein: the nozzles include at least a first nozzle and a second nozzle that are arranged in a direction perpendicular to a relative movement direction in which the head assembly section is relatively moved with respect to the recording medium while discharging ink; and the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse, wherein the first driving pulse is supplied to the pressure application means corresponding to the first nozzle while the second driving pulse is supplied to the pressure application means corresponding to the second nozzle.

Thus, by supplying the preliminary pulse from the driving pulse supply means to the pressure application means, the ink meniscus in the tip portion of a nozzle vibrates, thereby changing the state of the ink meniscus. Therefore, the volume of an ink droplet to be discharged in response to the discharge pulse, the direction in which the ink droplet is to be discharged, etc., can be changed depending upon the presence/absence of the preliminary pulse. Thus, by supplying the first driving pulse, one or both of the diameter and the landing position of an ink dot can be changed, as compared with those in a case where the second driving pulse is supplied. Therefore, by supplying the first driving pulse to the pressure application means corresponding to the first nozzle, it is possible to correct the diameter and the landing position of an ink dot to an intended diameter and an intended landing position, thereby preventing a white streak extending in the relative movement direction from appearing on the recording medium due to a defect of the ink jet recording apparatus, etc. Moreover, it is no longer necessary to perform N-pass recording as in the prior art, whereby it is possible to prevent a decrease in the recording speed. Thus, according to the first aspect of the present invention, it is possible to prevent a white streak extending in the relative movement direction from appearing on the recording medium while preventing a decrease in the recording speed.

When the first driving pulse is supplied from the driving pulse supply means to the pressure application means, one or both of the diameter and the landing position of an ink dot will change. Then, the ink discharging velocity may change. In such a case, the landing position of the ink dot shifts with respect to the relative movement direction. As a result, an image non-uniformity extending in the direction perpendicular to the relative movement direction may occur on the recording medium.

According to the first aspect of the present invention, the driving pulse supply means supplies the second driving pulse to the pressure application means corresponding to the second nozzle, whereby the discharging velocity of the ink droplet discharged from the second nozzle does not change. Therefore, the landing position of the ink dot from the second nozzle does not shift with respect to the relative movement direction. Thus, according to the first aspect of the present invention, it is possible to prevent an image non-uniformity extending in the direction perpendicular to the relative movement direction from occurring on the recording medium.

According to a second aspect of the present invention, there is provided an ink jet recording apparatus, including a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein: the nozzles include a plurality of nozzles that are arranged in a direction perpendicular to a relative movement direction in which the head assembly section is relatively moved with respect to the recording medium while discharging ink; and the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse, wherein the first driving pulse is supplied to the pressure application means corresponding at least one of the plurality of nozzles in a predetermined printing period while the second driving pulse is supplied thereto in a printing period different from the predetermined printing period.

Thus, by supplying the preliminary pulse from the driving pulse supply means to the pressure application means, the ink meniscus in the tip portion of a nozzle vibrates, thereby changing the state of the ink meniscus. Therefore, the volume of an ink droplet to be discharged in response to the discharge pulse, the direction in which the ink droplet is to be discharged, etc., can be changed depending upon the presence/absence of the preliminary pulse. Thus, by supplying the first driving pulse, one or both of the diameter and the landing position of an ink dot can be changed, as compared with those in a case where the second driving pulse is supplied. Therefore, by supplying the first driving pulse to the pressure application means in the predetermined printing period while supplying the second driving pulse thereto in a printing period different from the predetermined printing period, it is possible to correct the diameter and the landing position of an ink dot to an intended diameter and an intended landing position, thereby preventing a white streak extending in the relative movement direction from appearing on the recording medium due to a defect of the ink jet recording apparatus, etc. Moreover, it is no longer necessary to perform N-pass recording as in the prior art, whereby it is possible to prevent a decrease in the recording speed. Thus, according to the second aspect of the present invention, it is possible to prevent a white streak extending in the relative movement direction from appearing on the recording medium while preventing a decrease in the recording speed.

According to a third aspect of the present invention, there is provided an ink jet recording apparatus according to the second aspect, wherein: the ink jet recording apparatus further includes reference pulse generation means for generating a reference pulse including a first reference pulse and a second reference pulse, the first reference pulse including the preliminary pulse and the discharge pulse in this order, and the second reference pulse including the discharge pulse; and the driving pulse supply means supplies, to the pressure application means, the reference pulse generated by the reference pulse generation means as the driving pulse.

Thus, since the driving pulse supply means supplies the reference pulse as a driving pulse to the pressure application means, it is no longer necessary to provide the driving pulse supply means with means for producing a driving pulse from the preliminary pulse and the discharge pulse. Therefore, according to the third aspect of the present invention, the structure of the driving pulse supply means can be simplified.

According to a fourth aspect of the present invention, there is provided an ink jet recording apparatus according to the third aspect, wherein a waveform of the discharge pulse of the first reference pulse and that of the discharge pulse of the second reference pulse are different from each other.

When changing one or both of the diameter and the landing position of an ink dot by supplying the first reference pulse from the driving pulse supply means to the pressure application means, one or both of the volume of the ink droplet and the discharging velocity thereof may change. As a result, an image non-uniformity may occur on the recording medium.

According to the fourth aspect of the present invention, the waveform of the discharge pulse of the first reference pulse and that of the discharge pulse of the second reference pulse are different from each other so as to correct the difference in volume and/or the difference in discharging velocity between the ink droplet discharged in response to the first reference pulse and that discharged in response to the second reference pulse. Thus, one or both of the volume and the discharging velocity of the ink droplet can be made uniform. Therefore, according to the fourth aspect of the present invention, it is possible to prevent an image non-uniformity from occurring on the recording medium due to the supply of the first reference pulse.

According to a fifth aspect of the present invention, there is provided an ink jet recording apparatus according to the first aspect, wherein where the driving pulse supply means supplies at least three first driving pulses, an interval between the first one of the first driving pulses and the second one of the first driving pulses is different from that between the second one of the first driving pulses and the third one of the first driving pulses.

As described above, when the first driving pulse is supplied from the driving pulse supply means to the pressure application means, one or both of the diameter and the landing position of an ink dot will change. Then, the ink discharging velocity may change. In such a case, the landing position of the ink dot shifts with respect to the relative movement direction. As a result, an image non-uniformity extending in the direction perpendicular to the relative movement direction may occur on the recording medium. If the interval between the first one of the first driving pulses and the second one of the first driving pulses is equal to that between the second one of the first driving pulses and the third one of the first driving pulses, image non-uniformities extending in the direction perpendicular to the relative movement direction occur at regular intervals on the recording medium.

According to the fifth aspect of the present invention, the interval between the first one of the first driving pulses and the second one of the first driving pulses is different from that between the second one of the first driving pulses and the third one of the first driving pulses, whereby the image non-uniformities extending in the direction perpendicular to the relative movement direction occur at irregular intervals on the recording medium. Therefore, according to the aspect of the present invention, it is possible to prevent image non-uniformities extending in the direction perpendicular to the relative movement direction from occurring at regular intervals on the recording medium.

According to a sixth aspect of the present invention, there is provided an ink jet recording apparatus according to the second aspect, wherein where the driving pulse supply means supplies at least three first driving pulses, an interval between the first one of the first driving pulses and the second one of the first driving pulses is different from that between the second one of the first driving pulses and the third one of the first driving pulses.

Thus, functions and effects similar to those of the fifth aspect can be obtained.

According to a seventh aspect of the present invention, there is provided an ink jet recording apparatus, including a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein: the nozzles include at least a first nozzle and a second nozzle that are arranged in a direction perpendicular to a relative movement direction in which the head assembly section is relatively moved with respect to the recording medium while discharging ink; when the same driving pulse is supplied to the pressure application means corresponding to the first nozzle and to the pressure application means corresponding to the second nozzle, an ink droplet discharged through the second nozzle forms an ink dot whose diameter is a predetermined reference diameter and whose landing position is a reference landing position on the recording medium, while an ink droplet discharged through the first nozzle forms an ink dot whose diameter is different from the predetermined reference diameter and/or whose landing position is shifted from the reference landing position; and the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse, wherein the first driving pulse is supplied to the pressure application means corresponding to the first nozzle while the second driving pulse is supplied to the pressure application means corresponding to the second nozzle.

Thus, by supplying the preliminary pulse from the driving pulse supply means to the pressure application means, the ink meniscus in the tip portion of a nozzle vibrates, thereby changing the state of the ink meniscus. Therefore, the volume of an ink droplet to be discharged in response to the discharge pulse, the direction in which the ink droplet is to be discharged, etc., can be changed depending upon the presence/absence of the preliminary pulse. Thus, by supplying the first driving pulse, one or both of the diameter and the landing position of an ink dot can be changed, as compared with those in a case where the second driving pulse is supplied. Therefore, even if the diameter of the ink dot from the first nozzle is different from the predetermined reference diameter and/or the landing position thereof is shifted from the reference landing position due to a defect of the ink jet recording apparatus, etc., it is possible to prevent a white streak extending in the relative movement direction from appearing on the recording medium by changing one or both of the diameter and the landing position of the ink dot from the first nozzle so as to correct the difference. Moreover, it is no longer necessary to perform N-pass recording as in the prior art, whereby it is possible to prevent a decrease in the recording speed. Thus, according to the seventh aspect of the present invention, it is possible to prevent a white streak extending in the relative movement direction from appearing on the recording medium while preventing a decrease in the recording speed.

According to an eighth aspect of the present invention, there is provided an ink jet recording apparatus according to the first aspect, wherein: the ink jet recording apparatus further includes reference pulse generation means for generating a reference pulse for driving the pressure application means; the reference pulse includes the preliminary pulse and the discharge pulse; and the driving pulse supply means produces one of the first and second driving pulses from the preliminary pulse and the discharge pulse generated by the reference pulse generation means, and supplies the produced pulse to the pressure application means.

Thus, the driving pulse supply means produces one of the first and second driving pulses from the preliminary pulse and the discharge pulse generated by the reference pulse generation means. Therefore, according to the eighth aspect of the present invention, various driving pulses can be produced.

According to a ninth aspect of the present invention, there is provided an ink jet recording apparatus according to the second aspect, wherein: the ink jet recording apparatus further includes reference pulse generation means for generating a reference pulse for driving the pressure application means; the reference pulse includes the preliminary pulse and the discharge pulse; and the driving pulse supply means produces one of the first and second driving pulses from the preliminary pulse and the discharge pulse generated by the reference pulse generation means, and supplies the produced pulse to the pressure application means.

Thus, functions and effects similar to those of the eighth aspect can be obtained.

According to a tenth aspect of the present invention, there is provided an ink jet recording apparatus according to the seventh aspect, wherein: the ink jet recording apparatus further includes reference pulse generation means for generating a reference pulse for driving the pressure application means; the reference pulse includes the preliminary pulse and the discharge pulse; and the driving pulse supply means produces one of the first and second driving pulses from the preliminary pulse and the discharge pulse generated by the reference pulse generation means, and supplies the produced pulse to the pressure application means.

Thus, functions and effects similar to those of the eighth aspect can be obtained.

According to an eleventh aspect of the present invention, there is provided an ink jet recording apparatus according to the first aspect, wherein an amplitude of the preliminary pulse is equal to that of the discharge pulse, and a pulse width of the preliminary pulse is $1/40$ to $1/5$ of a Helmholtz period of the head assembly section.

Thus, the amplitude of the preliminary pulse is equal to that of the discharge pulse, whereby it is possible to produce the preliminary pulse and the discharge pulse simply by turning ON/OFF a constant voltage. Therefore, according to the eleventh aspect of the present invention, the preliminary pulse and the discharge pulse can easily be produced.

Moreover, since the pulse width of the preliminary pulse is equal to or greater than 1/40 of the Helmholtz period of the head assembly section, it is possible to vibrate the ink meniscus in the tip portion of the nozzle by supplying the preliminary pulse from the driving pulse supply means to the pressure application means. Moreover, since the pulse width of the preliminary pulse is less than or equal to 1/5 of the Helmholtz period of the head assembly section, an ink droplet is not discharged from the nozzle when the preliminary pulse is supplied from the driving pulse supply means to the pressure application means. Thus, according to the eleventh aspect of the present invention, one or both of the diameter and the landing position of the ink dot corresponding to the pressure application means can reliably be changed by supplying the first driving pulse from the driving pulse supply means to the pressure application means.

According to a twelfth aspect of the present invention, there is provided an ink jet recording apparatus according to the second aspect, wherein an amplitude of the preliminary pulse is equal to that of the discharge pulse, and a pulse width of the preliminary pulse is 1/40 to 1/5 of a Helmholtz period of the head assembly section.

Thus, functions and effects similar to those of the eleventh aspect can be obtained.

According to a thirteenth aspect of the present invention, there is provided an ink jet recording apparatus according to the seventh aspect, wherein an amplitude of the preliminary pulse is equal to that of the discharge pulse, and a pulse width of the preliminary pulse is 1/40 to 1/5 of a Helmholtz period of the head assembly section.

Thus, functions and effects similar to those of the eleventh aspect can be obtained.

According to a fourteenth aspect of the present invention, there is provided an ink jet recording apparatus according to the first aspect, wherein an interval between a start of the preliminary pulse and a start of the discharge pulse in the first driving pulse is less than or equal to twice a Helmholtz period of the head assembly section.

Thus, the interval between the start of the preliminary pulse and the start of the discharge pulse is less than or equal to twice the Helmholtz period of the head assembly section, whereby the discharge pulse is supplied while the ink meniscus in the tip portion of the nozzle is still sufficiently in the vibration caused by the preliminary pulse. Therefore, according to the fourteenth aspect of the present invention, one or both of the diameter and the landing position of the ink dot corresponding to the pressure application means can reliably be changed by supplying the first driving pulse from the driving pulse supply means to the pressure application means.

According to a fifteenth aspect of the present invention, there is provided an ink jet recording apparatus according to the second aspect, wherein an interval between a start of the preliminary pulse and a start of the discharge pulse in the first driving pulse is less than or equal to twice a Helmholtz period of the head assembly section.

Thus, functions and effects similar to those of the fourteenth aspect can be obtained.

According to a sixteenth aspect of the present invention, there is provided an ink jet recording apparatus according to the seventh aspect, wherein an interval between a start of the preliminary pulse and a start of the discharge pulse in the first driving pulse is less than or equal to twice a Helmholtz period of the head assembly section.

Thus, functions and effects similar to those of the fourteenth aspect can be obtained.

According to a seventeenth aspect of the present invention, there is provided an ink jet recording apparatus according to the first aspect, wherein a landing position of a first ink dot that is formed by supplying the second driving pulse to the pressure application means and that of a second ink dot that is formed by supplying the first driving pulse to the pressure application means are different from each other with respect to the direction perpendicular to the relative movement direction.

Thus, the landing position of the first ink dot and that of the second ink dot are different from each other with respect to the direction perpendicular to the relative movement direction. Therefore, according to the seventeenth aspect of the present invention, even if the landing position of an ink dot is shifted from the predetermined landing position with respect to the direction perpendicular to the relative movement direction due to a defect of the ink jet recording apparatus, etc., it is possible to reliably prevent a white streak extending in the relative movement direction from appearing on the recording medium by changing the landing position of the ink dot with respect to the direction perpendicular to the relative movement direction.

According to an eighteenth aspect of the present invention, there is provided an ink jet recording apparatus according to the second aspect, wherein a landing position of a first ink dot that is formed by supplying the second driving pulse to the pressure application means and that of a second ink dot that is formed by supplying the first driving pulse to the pressure application means are different from each other with respect to the direction perpendicular to the relative movement direction.

Thus, functions and effects similar to those of the seventeenth aspect can be obtained.

According to a nineteenth aspect of the present invention, there is provided an ink jet recording apparatus according to the seventh aspect, wherein a landing position of a first ink dot that is formed by supplying the second driving pulse to the pressure application means and that of a second ink dot that is formed by supplying the first driving pulse to the pressure application means are different from each other with respect to the direction perpendicular to the relative movement direction.

Thus, functions and effects similar to those of the seventeenth aspect can be obtained.

According to a twentieth aspect of the present invention, there is provided an ink jet recording apparatus according to the seventeenth aspect, wherein when the preliminary pulse is supplied to the pressure application means, a cross section, perpendicular to the relative movement direction, of the ink meniscus in the tip portion of the nozzle corresponding to the pressure application means is asymmetric about an axis of the nozzle.

Thus, by supplying the preliminary pulse from the driving pulse supply means to the pressure application means, the cross section, perpendicular to the relative movement direction, of the ink meniscus in the tip portion of the nozzle corresponding to the pressure application means is made asymmetric about the axis of the nozzle. Therefore, when the discharge pulse is supplied following the preliminary pulse, an ink droplet is discharged in a direction inclined from the axis of the nozzle. Therefore, according to the twentieth aspect of the present invention, the landing position of the ink dot from a nozzle can reliably be changed with respect to the direction perpendicular to the relative movement direction by supplying the first driving pulse from the driving pulse supply means to the pressure application means corresponding to the nozzle.

According to a twenty-first aspect of the present invention, there is provided an ink jet recording apparatus according to the eighteenth aspect, wherein when the preliminary pulse is supplied to the pressure application means, a cross section, perpendicular to the relative movement direction, of the ink meniscus in the tip portion of the nozzle corresponding to the pressure application means is asymmetric about an axis of the nozzle.

Thus, functions and effects similar to those of the twentieth aspect can be obtained.

According to a twenty-second aspect of the present invention, there is provided an ink jet recording apparatus according to the nineteenth aspect, wherein when the preliminary pulse is supplied to the pressure application means, a cross section, perpendicular to the relative movement direction, of the ink meniscus in the tip portion of the nozzle corresponding to the pressure application means is asymmetric about an axis of the nozzle.

Thus, functions and effects similar to those of the twentieth aspect can be obtained.

According to a twenty-third aspect of the present invention, there is provided an ink jet recording apparatus according to the seventeenth aspect, wherein each of the nozzles arranged in the direction perpendicular to the relative movement direction is shifted from a center of the pressure chamber that is communicated to the nozzle with respect to the direction perpendicular to the relative movement direction.

Thus, each of the nozzles arranged in the direction perpendicular to the relative movement direction is shifted from the center of the pressure chamber that is communicated to the nozzle with respect to the direction perpendicular to the relative movement direction. Therefore, by supplying the preliminary pulse from the driving pulse supply means to the pressure application means, the cross section, perpendicular to the relative movement direction, of the ink meniscus in the tip portion of the nozzle corresponding to the pressure application means is reliably made asymmetric about the axis of the nozzle. Therefore, according to the twenty-third aspect of the present invention, the landing position of the ink dot can reliably be changed with respect to the direction perpendicular to the relative movement direction by supplying the first driving pulse from the driving pulse supply means to the pressure application means.

According to a twenty-fourth aspect of the present invention, there is provided an ink jet recording apparatus according to the eighteenth aspect, wherein each of the nozzles arranged in the direction perpendicular to the relative movement direction is shifted from a center of the pressure chamber that is communicated to the nozzle with respect to the direction perpendicular to the relative movement direction.

Thus, functions and effects similar to those of the twenty-third aspect can be obtained.

According to a twenty-fifth aspect of the present invention, there is provided an ink jet recording apparatus according to the nineteenth aspect, wherein each of the nozzles arranged in the direction perpendicular to the relative movement direction is shifted from a center of the pressure chamber that is communicated to the nozzle with respect to the direction perpendicular to the relative movement direction.

Thus, functions and effects similar to those of the twenty-third aspect can be obtained.

According to a twenty-sixth aspect of the present invention, there is provided an ink jet recording apparatus according to the seventeenth aspect, wherein a cross section, perpendicular to the relative movement direction, of each of the nozzles arranged in the direction perpendicular to the relative movement direction is asymmetric about an axis of the nozzle.

Thus, the cross section, perpendicular to the relative movement direction, of each of the nozzles arranged in the direction perpendicular to the relative movement direction is asymmetric about the axis of the nozzle. Therefore, by supplying the preliminary pulse from the driving pulse supply means to the pressure application means, the cross section, perpendicular to the relative movement direction, of the ink meniscus in the tip portion of the nozzle is reliably made asymmetric about the axis of the nozzle. Therefore, according to the twenty-third aspect of the present invention, the landing position of the ink dot can reliably be changed with respect to the direction perpendicular to the relative movement direction by supplying the first driving pulse from the driving pulse supply means to the pressure application means.

According to a twenty-seventh aspect of the present invention, there is provided an ink jet recording apparatus according to the eighteenth aspect, wherein a cross section, perpendicular to the relative movement direction, of each of the nozzles arranged in the direction perpendicular to the relative movement direction is asymmetric about an axis of the nozzle.

Thus, functions and effects similar to those of the twenty-sixth aspect can be obtained.

According to a twenty-eighth aspect of the present invention, there is provided an ink jet recording apparatus according to the nineteenth aspect, wherein a cross section, perpendicular to the relative movement direction, of each of the nozzles arranged in the direction perpendicular to the relative movement direction is asymmetric about an axis of the nozzle.

Thus, functions and effects similar to those of the twenty-sixth aspect can be obtained.

According to a twenty-ninth aspect of the present invention, there is provided an ink jet recording apparatus according to the seventeenth aspect, wherein a distance between a center of the first ink dot and a center of the second ink dot with respect to the direction perpendicular to the relative movement direction is less than or equal to ½ of a pitch of the ink dots.

According to the twenty-ninth aspect of the present invention, the distance between a center of the first ink dot and a center of the second ink dot with respect to the direction perpendicular to the relative movement direction is less than or equal to ½ of a pitch of the ink dots, thus suppressing the distance between the first ink dot and the second ink dot. Therefore, according to the twenty-ninth aspect of the present invention, the image quality can be improved.

According to a thirtieth aspect of the present invention, there is provided an ink jet recording apparatus according to the eighteenth aspect, wherein a distance between a center of the first ink dot and a center of the second ink dot with respect to the direction perpendicular to the relative movement direction is less than or equal to ½ of a pitch of the ink dots.

Thus, functions and effects similar to those of the twenty-ninth aspect can be obtained.

According to a thirty-first aspect of the present invention, there is provided an ink jet recording apparatus according to the nineteenth aspect, wherein a distance between a center of the first ink dot and a center of the second ink dot with respect to the direction perpendicular to the relative movement direction is less than or equal to ½ of a pitch of the ink dots.

Thus, functions and effects similar to those of the twenty-ninth aspect can be obtained.

According to a thirty-second aspect of the present invention, there is provided an ink jet recording apparatus according to the first aspect, wherein the driving pulse supply means selectively supplies, in addition to the first driving pulse and the second driving pulse, a third driving pulse including the preliminary pulse.

Thus, the driving pulse supply means selectively supplies the third driving pulse as the driving pulse. Therefore, according to the thirty-second aspect of the present invention, it is possible to prevent ink in the pressure chamber from becoming dry with an increase in its viscosity by supplying the third driving pulse.

According to a thirty-third aspect of the present invention, there is provided an ink jet recording apparatus according to the second aspect, wherein the driving pulse supply means selectively supplies, in addition to the first driving pulse and the second driving pulse, a third driving pulse including the preliminary pulse.

Thus, functions and effects similar to those of the thirty-second aspect can be obtained.

According to a thirty-fourth aspect of the present invention, there is provided an ink jet recording apparatus according to the seventh aspect, wherein the driving pulse supply means selectively supplies, in addition to the first driving pulse and the second driving pulse, a third driving pulse including the preliminary pulse.

Thus, functions and effects similar to those of the thirty-second aspect can be obtained.

According to a thirty-fifth aspect of the present invention, there is provided an ink jet recording apparatus according to the first aspect, wherein each of the pressure application means is a piezoelectric element.

Thus, the pressure application means is a piezoelectric element, whereby it is easy to control the contraction and expansion of the pressure chamber. Therefore, it is possible to reliably control the diameter and the landing position of an ink dot. Thus, according to the thirty-fifth aspect of the present invention, the image quality can be improved.

According to a thirty-sixth aspect of the present invention, there is provided an ink jet recording apparatus according to the second aspect, wherein each of the pressure application means is a piezoelectric element.

Thus, functions and effects similar to those of the thirty-fifth aspect can be obtained.

According to a thirty-seventh aspect of the present invention, there is provided an ink jet recording apparatus according to the seventh aspect, wherein each of the pressure application means is a piezoelectric element.

Thus, functions and effects similar to those of the thirty-fifth aspect can be obtained.

According to the present invention, the ink meniscus in the tip portion of the nozzle is vibrated by supplying the preliminary pulse from the driving pulse supply means to the pressure application means, whereby the volume of an ink droplet to be discharged in response to the discharge pulse, the direction in which the ink droplet is to be discharged, etc., can be changed depending upon the presence/absence of the preliminary pulse. Thus, by supplying the first driving pulse, one or both of the diameter and the landing position of an ink dot can be changed, as compared with those in a case where the second driving pulse is supplied. Therefore, by supplying the first driving pulse to the pressure application means corresponding to the first nozzle, it is possible to correct the diameter and the landing position of an ink dot to an intended diameter and an intended landing position, thereby preventing a white streak extending in the relative movement direction from appearing on the recording medium due to a defect of the ink jet recording apparatus, etc. Moreover, it is no longer necessary to perform N-pass recording as in the prior art, whereby it is possible to prevent a decrease in the recording speed. Thus, according to the present invention, it is possible to prevent a white streak extending in the relative movement direction from appearing on the recording medium while preventing a decrease in the recording speed.

When the first driving pulse is supplied from the driving pulse supply means to the pressure application means, one or both of the diameter and the landing position of an ink dot will change. Then, the ink discharging velocity may change. In such a case, the landing position of the ink dot shifts with respect to the relative movement direction. As a result, an image non-uniformity extending in the direction perpendicular to the relative movement direction may occur on the recording medium.

According to the present invention, the driving pulse supply means supplies the second driving pulse to the pressure application means corresponding to the second nozzle, whereby the discharging velocity of the ink droplet discharged from the second nozzle does not change. Therefore, the landing position of the ink dot from the second nozzle does not shift with respect to the relative movement direction, whereby it is possible to prevent an image non-uniformity extending in the direction perpendicular to the relative movement direction from occurring on the recording medium.

Moreover, the ink meniscus in the tip portion of the nozzle is vibrated by supplying the preliminary pulse from the driving pulse supply means to the pressure application means, whereby the volume of an ink droplet to be discharged in response to the discharge pulse, the direction in which the ink droplet is to be discharged, etc., can be changed depending upon the presence/absence of the preliminary pulse. Thus, by supplying the first driving pulse, one or both of the diameter and the landing position of an ink dot can be changed, as compared with those in a case where the second driving pulse is supplied. Therefore, by supplying the first driving pulse to at least one of the plurality of pressure application means arranged in the direction perpendicular to the relative movement direction in the predetermined printing period while supplying the second driving pulse thereto in a printing period different from the predetermined printing period, it is possible to correct the diameter and the landing position of an ink dot to an intended diameter and an intended landing position, thereby preventing a white streak extending in the relative movement direction from appearing on the recording medium due to a defect of the ink jet recording apparatus, etc.

Moreover, the ink meniscus in the tip portion of the nozzle is vibrated by supplying the preliminary pulse from the driving pulse supply means to the pressure application means. Therefore, one or both of the diameter and the landing position of an ink dot can be changed by supplying, to the pressure application means corresponding to the first nozzle, the first driving pulse including the preliminary pulse and the discharge pulse in this order. Moreover, the diameter and the landing position of an ink dot are not changed when the second driving pulse including the discharge pulse is supplied to the pressure application means corresponding to the second nozzle. Therefore, even if the diameter of the ink dot from the first nozzle is different from the predetermined reference diameter and/or the landing position thereof is shifted from the reference landing position due to a defect of the ink jet recording apparatus, etc., it is possible to prevent a white streak extending in the relative movement direction from appearing on the recording medium by changing one or both of the diameter and the landing position of the ink dot from the first nozzle so as to correct the difference.

BEST MODE FOR CARRYING OUT THE INVENTION

Embodiment 1

Figure 1:
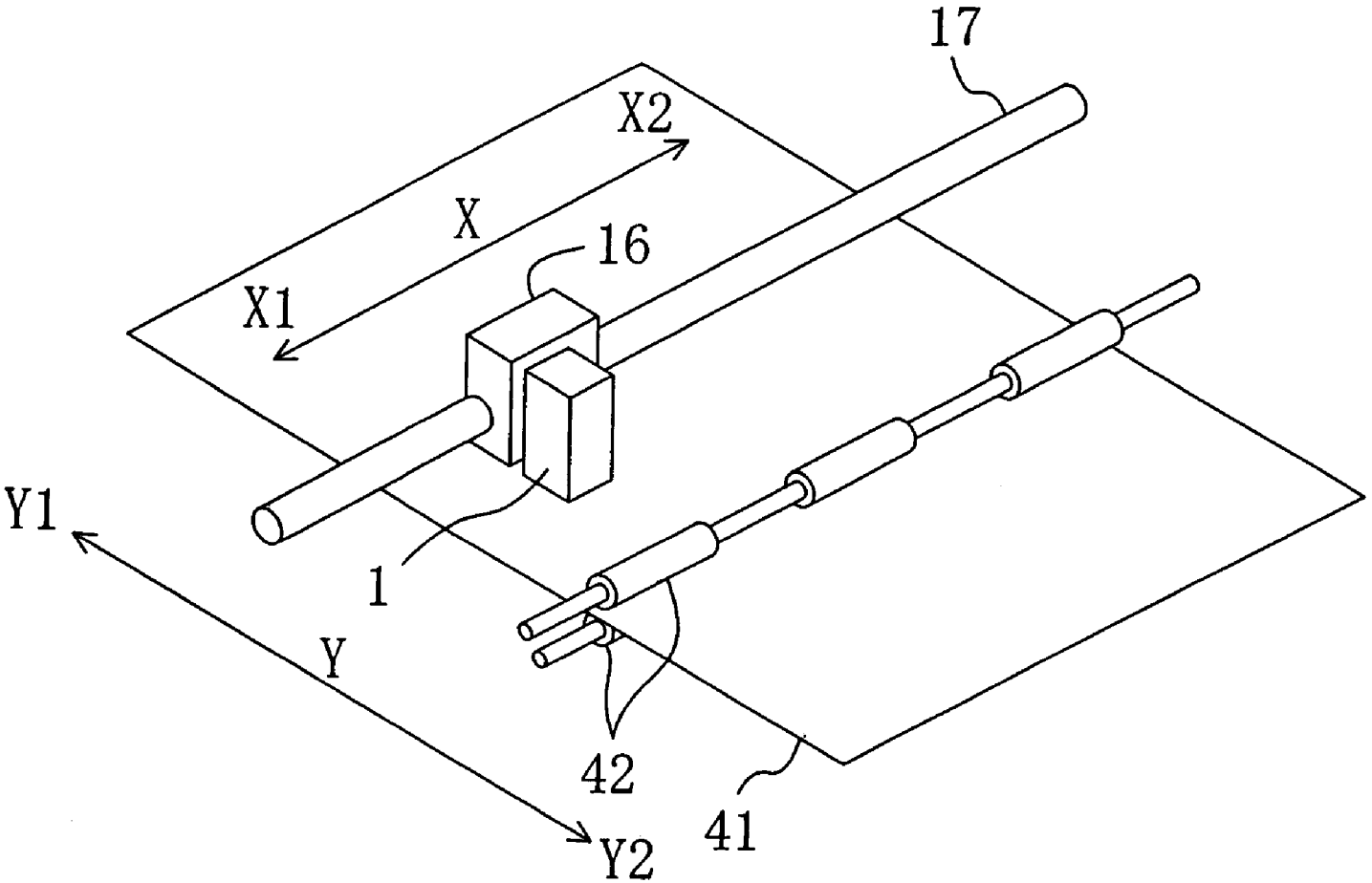
FIG. 1 is a schematic perspective view illustrating an ink jet recording apparatus according to one embodiment of the present invention.
Figure 6:
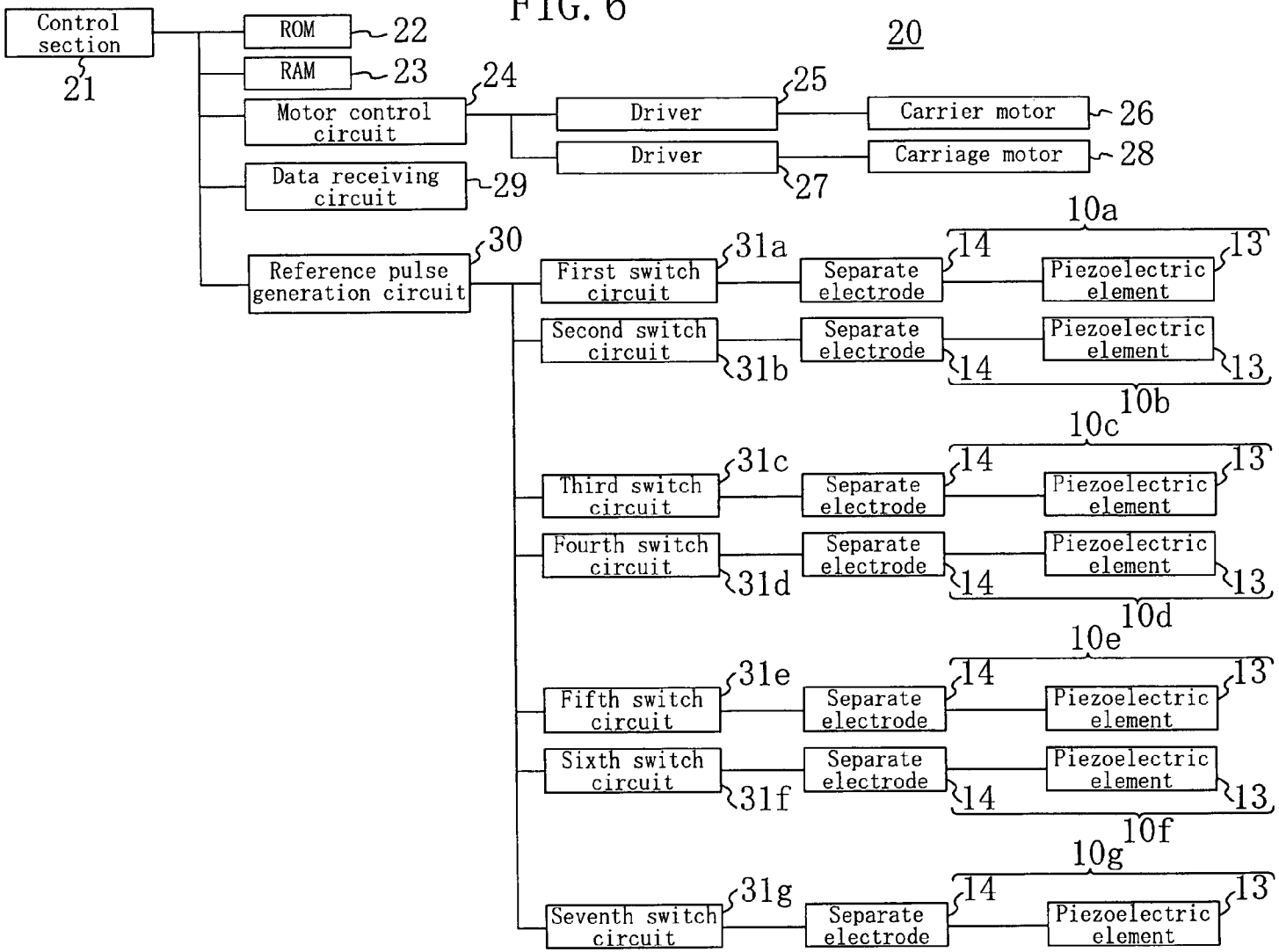
FIG. 6 is a block diagram illustrating a configuration of a driver unit.

As illustrated in FIG. 1, an ink jet recording apparatus of the present embodiment includes an ink jet head 1 for discharging ink droplets onto recording paper 41, a carriage 16 for relatively moving the ink jet head 1 and the recording paper 41 with respect to each other, a carriage shaft 17, and a carriage motor 28 (see FIG. 6). The ink jet head 1 is supported by and fixed to the carriage 16. The carriage 16 is movably supported by the carriage shaft 17 extending in the primary scanning direction X. The carriage 16 is provided with the carriage motor 28. By driving the carriage motor 28, the ink jet head 1 and the carriage 16 move along the carriage shaft 17. Note that the recording paper 41 corresponds to the "recording medium" as used herein, and the primary scanning direction X corresponds to the "relative movement direction" as used herein.

The recording paper 41 is held by carrier rollers 42 (by being pinched between upper three rollers and lower three rollers) rotated by a carrier motor 26 (see FIG. 6). By driving the carrier motor 26, the recording paper 41 is carried in the secondary scanning direction Y perpendicular to the primary scanning direction X. Note that the secondary scanning direction Y corresponds to the "direction perpendicular to the relative movement direction" as used herein.

As illustrated in FIG. 2 to FIG. 5, the ink jet head 1 includes a plurality of pressure chambers 4 storing ink therein, a plurality of nozzles 2 communicated respectively to the pressure chambers 4, and a plurality of piezoelectric actuators 10 for applying a pressure on the pressure chambers 4 so as to discharge ink droplets through the nozzles 2. Note that the piezoelectric actuator 10 corresponds to the "pressure application means" as used herein.

Figure 2:
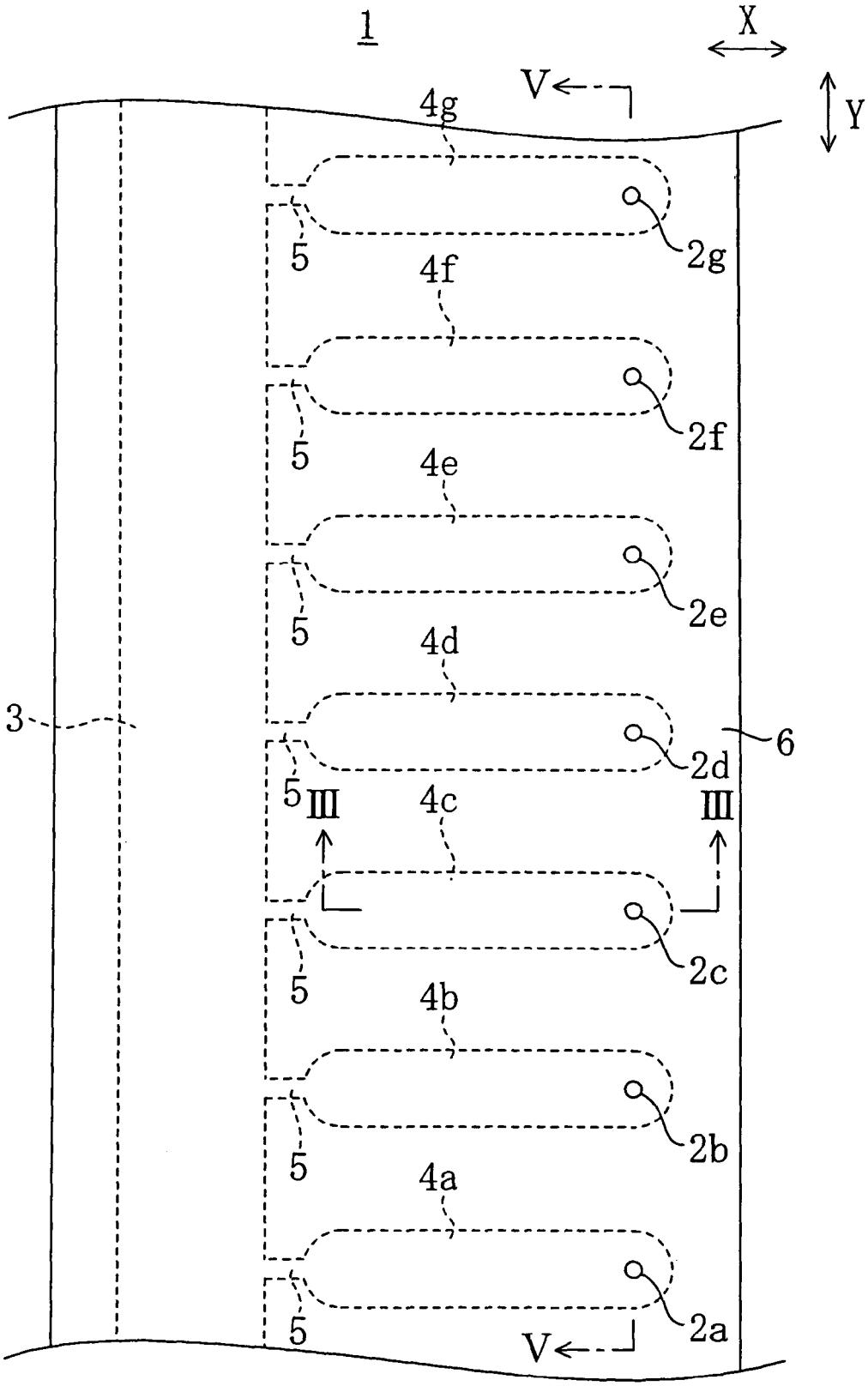
FIG. 2 is a diagram illustrating a portion of a bottom surface of an ink jet head.

As illustrated in FIG. 2, the pressure chambers 4 are formed inside the ink jet head 1 each in the form of an elongate groove extending in the primary scanning direction X, and are arranged at a predetermined interval in the secondary scanning direction Y. In the present embodiment, seven pressure chambers 4 are arranged at a predetermined interval in the secondary scanning direction Y. The seven pressure chambers 4 are first to seventh pressure chambers 4*a*, 4*b*, 4*c*, 4*d*, 4*e*, 4*f* and 4*g*. The nozzle 2 is formed at one end (the right-side end in FIG. 2) of each pressure chamber 4 on the bottom surface of the ink jet head 1. In the present embodiment, first to seventh nozzles 2*a*, 2*b*, 2*c*, 2*d*, 2*e*, 2*f* and 2*g* are arranged at a predetermined interval in the secondary scanning direction Y, corresponding to the first to seventh pressure chambers 4*a*, 4*b*, 4*c*, 4*d*, 4*e*, 4*f* and 4*g*, respectively. One end of an ink supply channel 5 is connected to the other end (the left-side end in FIG. 2) of each pressure chamber 4 on the bottom surface of the ink jet head 1. The other end of the ink supply channel 5 is connected to an ink supply chamber 3 extending in the secondary scanning direction Y.

Figure 3:
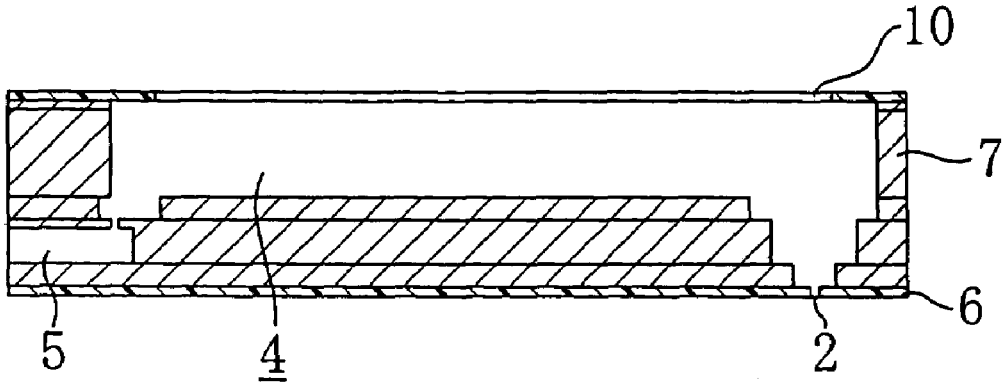
FIG. 3 is a cross-sectional view taken along line III—III of FIG. 2.

Moreover, as illustrated in FIG. 3, a nozzle plate 6 including the nozzle 2 formed therein, a partition wall 7 for partitioning the pressure chamber 4 and the ink supply channel 5 from each other, and the piezoelectric actuator 10 are deposited in this order to form the ink jet head 1. The nozzle plate 6 is a polyimide plate having a thickness of 20 μm, and the partition wall 7 is a stainless steel laminate having a thickness of 280 μm. Note that the nozzle plate 6 and the partition wall 7 correspond to the "head assembly section" as used herein.

Figure 4:
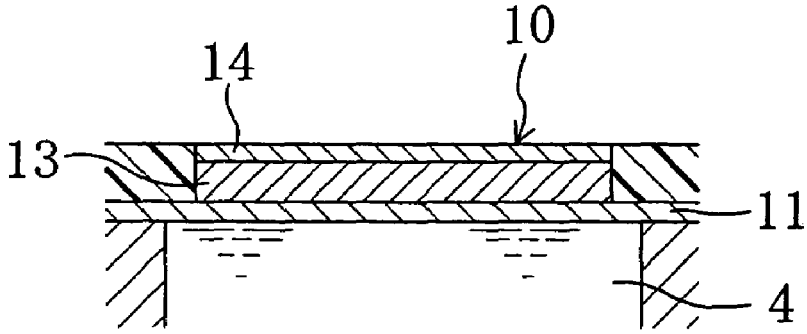
FIG. 4 is a cross-sectional view illustrating a portion around a piezoelectric actuator.
Figure 5:
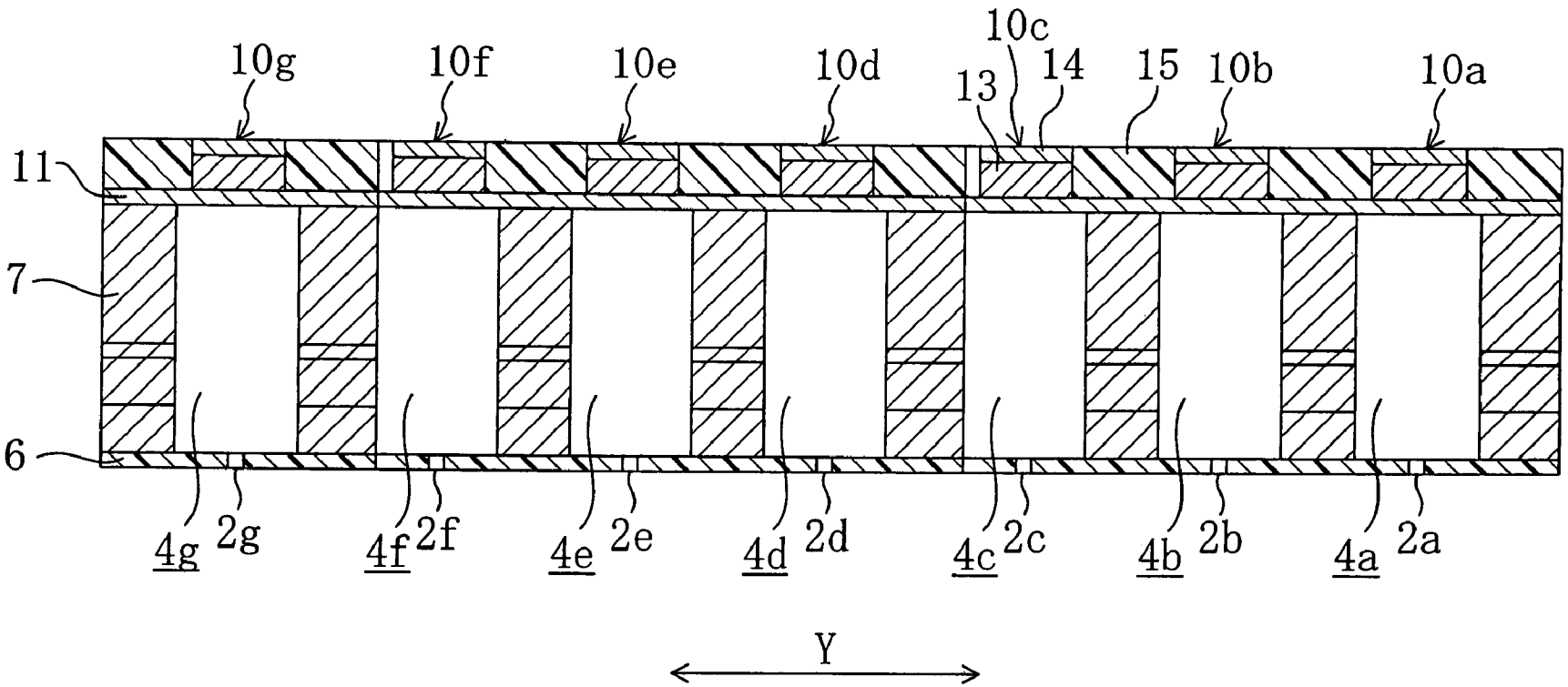
FIG. 5 is a cross-sectional view taken along line V—V of FIG. 2.

As illustrated in FIG. 5, the piezoelectric actuators 10 are arranged at a predetermined interval in the secondary scanning direction Y. In the present embodiment, first to seventh piezoelectric actuators 10*a*, 10*b*, 10*c*, 10*d*, 10*e*, 10*f* and 10*g* are located directly above the first to seventh pressure chambers 4*a*, 4*b*, 4*c*, 4*d*, 4*e*, 4*f* and 4*g*, respectively. As illustrated in FIG. 4 and FIG. 5, a vibration plate 11 covering the opening of the pressure chamber 4, a piezoelectric element 13 for vibrating the vibration plate 11, and a separate electrode 14 are deposited in this order to form the piezoelectric actuator 10. The vibration plate 11 is a chromium plate having a thickness of 2 μm, and functions also as a common electrode for applying, together with the separate electrode 14, a voltage across the piezoelectric element 13. The piezoelectric element 13 is made of PZT (lead zirconate titanate) and has a thickness of 3 μm. The piezoelectric element 13 is located directly above the pressure chamber 4. The separate electrode 14 is made of Pt and has a thickness of 0.1 μm. Note that an insulating plate 15 made of polyimide is provided between adjacent piezoelectric elements 13 (adjacent separate electrodes 14).

Next, the configuration of a driver unit 20 of the ink jet recording apparatus will be described with reference to the block diagram of FIG. 6. The driver unit 20 includes a control section 21, being a CPU, a ROM 22 storing routines for various data processing operations, etc., a RAM 23 for storing various data, etc., a driver circuit 25 and a driver circuit 27 for driving the carrier motor 26 and the carriage motor 28, respectively, a motor control circuit 24 for controlling the carrier motor 26 and the carriage motor 28, a data receiving circuit 29 for receiving print data, a reference pulse generation circuit 30, and switch circuits 31. Note that the reference pulse generation circuit 30 corresponds to the "reference pulse generation means" as used herein, and the switch circuits 31 correspond to the "driving pulse supply means" as used herein.

The reference pulse generation circuit 30 is a circuit for generating, at a predetermined cycle, a first reference pulse P4*a* (see FIG. 7) based on which a driving pulse P3 including an preliminary pulse P1 and a discharge pulse P2 is produced.

Figure 7:
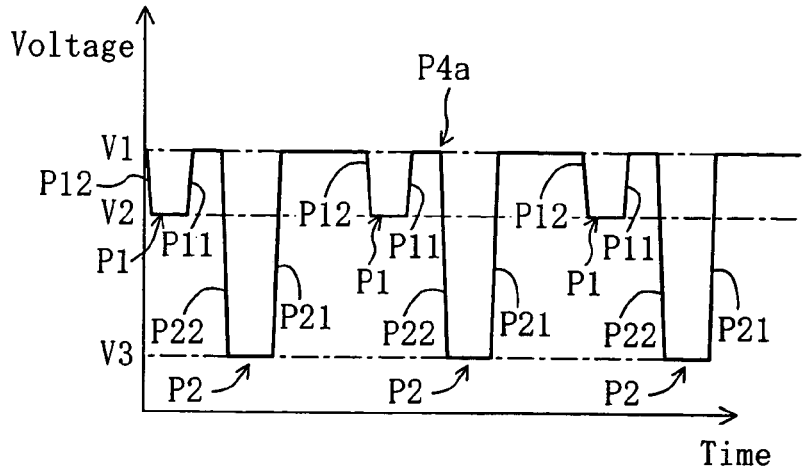
FIG. 7 is a waveform diagram illustrating a first reference pulse.

As illustrated in FIG. 7, the first reference pulse P4*a* includes the preliminary pulses P1 and the discharge pulses P2 alternating with each other.

The preliminary pulse P1 is for vibrating an ink meniscus in the tip portion of the nozzle 2. The preliminary pulse P1 is a trapezoidal pulse including a falling waveform P12 for deforming the piezoelectric actuator 10 so as to expand the pressure chamber 4, and a rising waveform P11 for deforming the piezoelectric actuator 10 so as to contract the pressure chamber 4. Note that when only the preliminary pulse P1 is input to the piezoelectric actuator 10, an ink droplet is not discharged from the nozzle 2.

The discharge pulse P2 is a pulse for discharging an ink droplet from the nozzle 2. The discharge pulse P2 is a trapezoidal pulse including a falling waveform P22 and a rising waveform P21. First, the falling waveform P22 is input to the separate electrode 14 of the piezoelectric actuator 10, thereby filling the pressure chamber 4 with ink. Then, the rising waveform P21 is input to the piezoelectric actuator 10, thereby discharging an ink droplet from the nozzle 2.

The amplitude V1–V2 of the preliminary pulse P1 is smaller than the amplitude V1–V3 of the discharge pulse P2. Note that the preliminary pulse P1 and the discharge pulse P2 have a so-called "pull-push" waveform.

As illustrated in FIG. 6, each switch circuit 31 is connected to the separate electrode 14 of one piezoelectric actuator 10, and includes a circuit component capable of being turned ON/OFF, such as a transistor. In the present embodiment, first to seventh switch circuits 31*a*, 31*b*, 31*c*, 31*d*, 31*e*, 31*f* and 31*g* are connected to the separate electrodes 14 of the first to seventh piezoelectric actuators 10*a*, 10*b*, 10*c*, 10*d*, 10*e*, 10*f* and 10*g*, respectively. While the ink jet head 1 is moved in the primary scanning direction, each switch circuit 31 selectively inputs the preliminary pulse P1 and the discharge pulse P2 of the first reference pulse P4*a* generated by the reference pulse generation circuit 30 to the corresponding piezoelectric actuator 10.

The pulse to be input as the driving pulse P3 by each switch circuit 31 to the corresponding piezoelectric actuator 10 is determined arbitrarily. In the present embodiment, a first driving pulse P3*a* to be described later is input to the second, fourth and sixth piezoelectric actuators 10*b*, 10*d* and 10*f*. On the other hand, a second driving pulse P3*b* to be described later is input to the first, third, fifth and seventh piezoelectric actuators 10*a*, 10*c*, 10*e* and 10*g*.

Figure 8A:
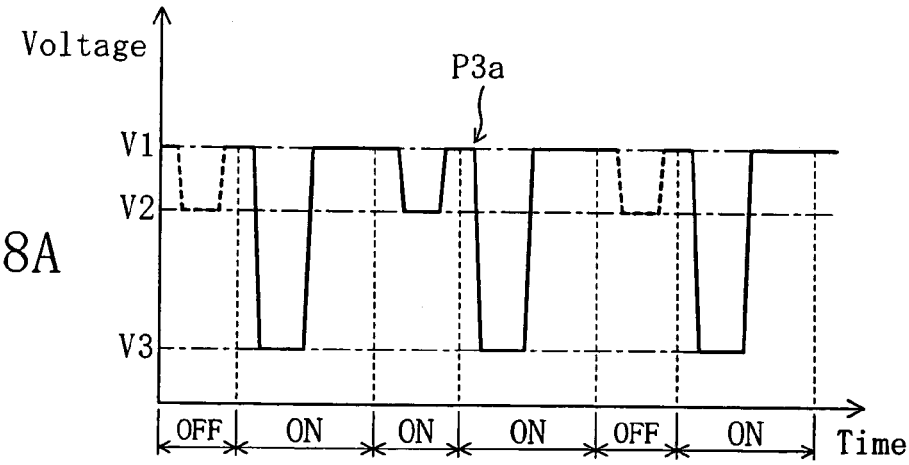
FIG. 8A is a waveform diagram illustrating a first driving pulse.

Specifically, the transistors of the second, fourth and sixth switch circuits 31*b*, 31*d* and 31*f* are turned OFF while the $2N-1^{th}$ (N is a natural number) preliminary pulse P1 (it is assumed herein that pulses and ink dots are counted rightward starting from the leftmost one) is being output, thereby producing the first driving pulse P3*a*, as illustrated in FIG. 8A. Then, the second, fourth and sixth switch circuits 31*b*, 31*d* and 31*f* input the first driving pulse P3*a* to the second, fourth and sixth piezoelectric actuators 10*b*, 10*d* and 10*f*, respectively.

Figure 8B:
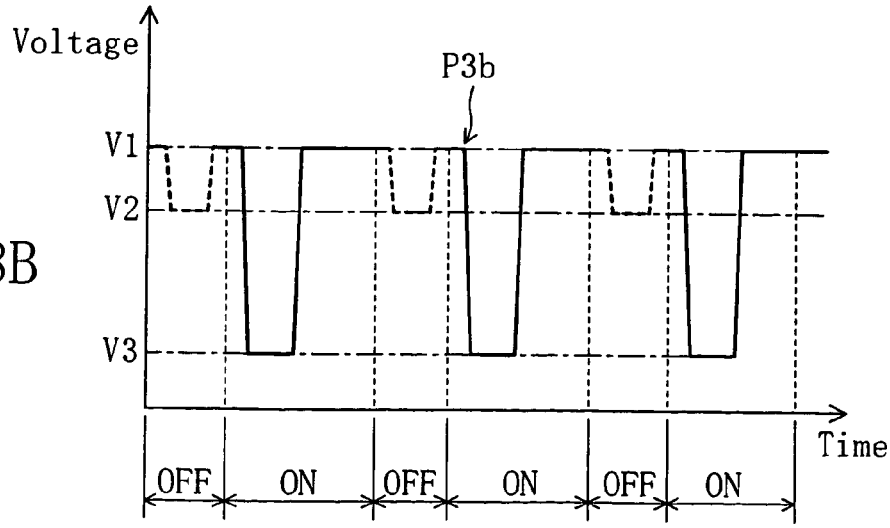
FIG. 8B is a waveform diagram illustrating a second driving pulse.

On the other hand, the transistors of the first, third, fifth and seventh switch circuits 31*a*, 31*c*, 31*e* and 31*g* are turned OFF while the preliminary pulse P1 of the first reference pulse P4*a* is being output, thereby producing the second driving pulse P3*b*, as illustrated in FIG. 8B. Then, the first, third, fifth and seventh switch circuits 31*a*, 31*c*, 31*e* and 31*g* input the second driving pulse P3*b* to the first, third, fifth and seventh piezoelectric actuators 10*a*, 10*c*, 10*e* and 10*g*, respectively. Note that the $2N^{th}$ preliminary pulse P1 and the $2N^{th}$ discharge pulse P2 of the first driving pulse P3*a* correspond to the "first driving pulse" as used herein, and the $2N^{th}$ discharge pulse P2 of the second driving pulse P3*b* corresponds to the "second driving pulse" as used herein.

Thus, the switch circuits 31 selectively supply a driving pulse including the preliminary pulse P1 and the discharge pulse P2 in this order and a driving pulse including the discharge pulse P2 to the piezoelectric actuators 10.

In the first driving pulse P3*a*, the interval between the start of the $2N^{th}$ preliminary pulse P1 and the start of the $2N^{th}$ discharge pulse P2 is less than or equal to twice the Helmholtz period of the head. In such a case, at the start of the discharge pulse P2, an ink meniscus 45 in the tip portion of the nozzle 2 is in a vibration. In other words, at the start of the discharge pulse P2, the ink meniscus 45 is not in its reference position (the position indicated by the solid line in FIG. 9), i.e., the stable position that is reached after vibration.

Recording Operation of Ink Jet Recording Apparatus

Next, the recording operation using the ink jet recording apparatus will be described.

First, the recording paper 41 is carried to a predetermined position by the carrier motor 26 and the carrier rollers 42. Then, the ink jet head 1 is carried, along with the carriage 16, by the carriage motor 28 from one end (the position X1 in FIG. 1) to the other end (the position X2 in FIG. 1) along the carriage shaft 17. During this process, the reference pulse generation circuit 30 generates the first reference pulse P4*a* at a predetermined cycle. The second, fourth and sixth switch circuits 31*b*, 31*d* and 31*f* input the first driving pulse P3*a* to the corresponding piezoelectric actuators 10. On the other hand, the first, third, fifth and seventh switch circuits 31*a*, 31*c*, 31*e* and 31*g* input the second driving pulse P3*b* to the corresponding piezoelectric actuators 10.

Figure 9:
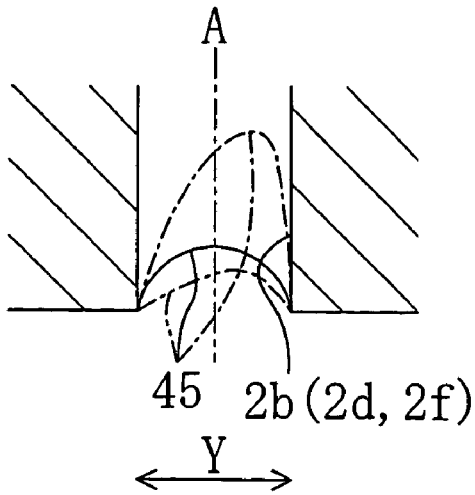
FIG. 9 is an enlarged cross-sectional view illustrating a portion around a nozzle, showing how an ink meniscus changes.
Figure 10:
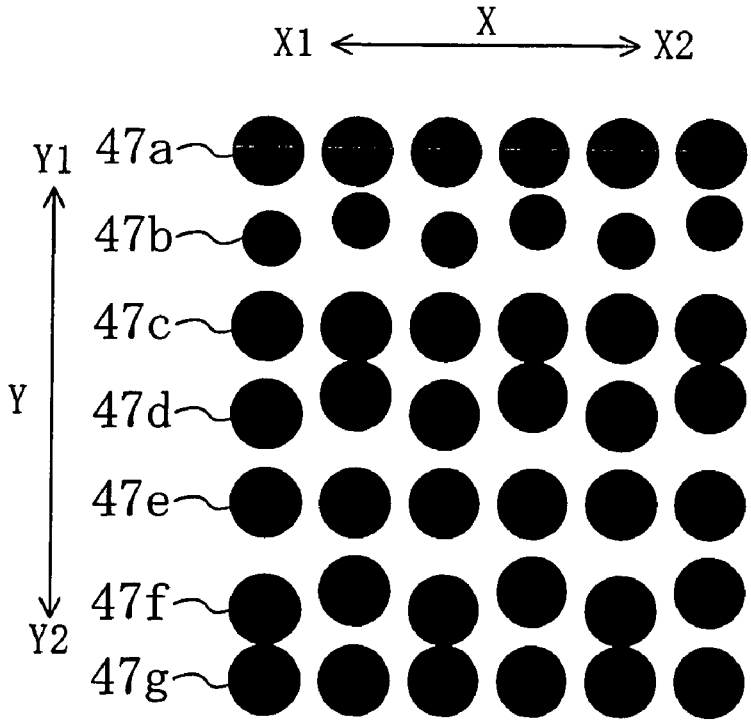
FIG. 10 is a diagram illustrating an ink dot pattern formed in a recording operation.

As illustrated in FIG. 9, upon receiving the $2N^{th}$ preliminary pulse P1, the ink meniscus 45 in the tip portion of the second, fourth and sixth nozzles 2*b*, 2*d* and 2*f* is displaced substantially from the reference position toward the pressure chamber 4, as indicated by a one-dot chain line. Then, the ink meniscus 45 is displaced toward the tip of the nozzle 2 (away from the pressure chamber 4) past the reference position, as indicated by a two-dot chain line. Thereafter, the ink meniscus 45 repeats the displacement toward and away from the pressure chamber 4. The vibration of the ink meniscus 45 is a damped vibration. The first driving pulse P3*a* is shaped so that the cross section of the ink meniscus 45 perpendicular to the primary scanning direction X is asymmetric about the axis A of the second, fourth and sixth nozzles 2*b*, 2*d* and 2*f* at the start of the $2N^{th}$ discharge pulse P2, and so that the landing positions of the $2N^{th}$ ones of second, fourth and sixth ink dots 47*b*, 47*d* and 47*f* are shifted upwardly (in the Y1 direction) from those of the $2N-1^{th}$ ones of the second, fourth and sixth ink dots 47*b*, 47*d* and 47*f*. Therefore, the direction in which ink droplets are discharged from the second, fourth and sixth nozzles 2*b*, 2*d* and 2*f* upon receiving the $2N^{th}$ discharge pulse P2 changes. Thus, as illustrated in FIG. 10, the landing positions of the $2N^{th}$ ones of the second, fourth and sixth ink dots 47*b*, 47*d* and 47*f* are shifted in the Y1 direction from those of the $2N-1^{th}$ ones of the second, fourth and sixth ink dots 47*b*, 47*d* and 47*f*. In the present embodiment, the centers of the $2N^{th}$ ones of the second, fourth and sixth ink dots 47*b*, 47*d* and 47*f* are shifted in the Y1 direction from those of the $2N-1^{th}$ ones of the second, fourth and sixth ink dots 47*b*, 47*d* and 47*f*, respectively, by ½ of the pitch of the ink dots 47. The amount of shift is preferably 1/40 to ½ of the pitch of the ink dots 47. Note that the $2N-1^{th}$ ones of the second, fourth and sixth ink dots 47*b*, 47*d* and 47*f* correspond to the "first ink dot" as used herein, and the $2N^{th}$ ones of the second, fourth and sixth ink dots 47*b*, 47*d* and 47*f* correspond to the "second ink dot" as used herein.

Thus, it is possible to prevent a white streak extending in the primary scanning direction X from appearing between first ink dots 47*a* and the second ink dots 47*b* or between fifth ink dots 47*e* and the sixth ink dots 47*f*.

According to the present embodiment, as the second, fourth and sixth switch circuits 31*b*, 31*d* and 31*f* input the $2N^{th}$ preliminary pulse P1, the ink meniscus 45 in the tip portion of the second, fourth and sixth nozzles 2*b*, 2*d* and 2*f* vibrates, thereby changing the state of the ink meniscus 45. Thus, the landing positions of the $2N^{th}$ ones of the second, fourth and sixth ink dots 47*b*, 47*d* and 47*f* are shifted in the Y1 direction from those of the $2N-1^{th}$ ones of the second, fourth and sixth ink dots 47*b*, 47*d* and 47*f*. Therefore, it is possible to prevent a white streak extending in the primary scanning direction X from appearing on the recording paper 41 between the first ink dots 47*a* and the second ink dots 47*b* or between the fifth ink dots 47*e* and the sixth ink dots 47*f*. Moreover, it is no longer necessary to perform N-pass recording as in the prior art, whereby it is possible to prevent a decrease in the recording speed. Thus, it is possible to prevent a white streak extending in the primary scanning direction X from appearing on the recording paper 41 while preventing a decrease in the recording speed.

Moreover, since the centers of the $2N^{th}$ ones of the second, fourth and sixth ink dots 47*b*, 47*d* and 47*f* are shifted in the Y1 direction from those of the $2N-1^{th}$ ones of the second, fourth and sixth ink dots 47*b*, 47*d* and 47*f*, respectively, only by ½ of the pitch of the ink dots 47, the amount of shift in the secondary scanning direction Y between the landing positions of the $2N^{th}$ ones of the second, fourth and sixth ink dots 47*b*, 47*d* and 47*f* and those of the $2N-1^{th}$ ones of the second, fourth and sixth ink dots 47*b*, 47*d* and 47*f* is kept small. Therefore, the image quality can be improved.

Moreover, since the interval between the start of the $2N^{th}$ preliminary pulse P1 of the first driving pulse P3*a* and the start of the $2N^{th}$ discharge pulse P2 thereof is less than or equal to twice the Helmholtz period of the head, the discharge pulse P2 will be received while the ink meniscus 45 in the tip portion of the second, fourth and sixth nozzles 2*b*, 2*d* and 2*f* is still sufficiently in the vibration caused by the preliminary pulse P1. Therefore, the landing positions of the $2N^{th}$ ones of the second, fourth and sixth ink dots 47*b*, 47*d* and 47*f* are reliably shifted in the Y1 direction from those of the $2N-1^{th}$ ones of the second, fourth and sixth ink dots 47*b*, 47*d* and 47*f*.

Moreover, each of the first to seventh switch circuits 31*a*, 31*b*, 31*c*, 31*d*, 31*e*, 31*f* and 31*g* produces one of the first and second driving pulses P3*a* and P3*b* from the preliminary pulse P1 and the discharge pulse P2, which are generated by the reference pulse generation circuit 30. Thus, various driving pulses P3 can be produced.

Moreover, since the piezoelectric actuator 10 is used as the pressure application means, it is easy to control the contraction/expansion of the pressure chamber 4. Therefore, it is possible to reliably control the diameter and the landing position of the ink dot 47, thereby improving the image quality.

Note that while the first driving pulse P3*a* is shaped so that the cross section of the ink meniscus 45 perpendicular to the primary scanning direction X is asymmetric about the axis A of the second nozzle 2*b*, etc., at the start of the $2N^{th}$ discharge pulse P2 in the present embodiment, the present invention is not limited to this. For example, the first driving pulse may alternatively be shaped so that ink is attached to the tip portion of the second nozzle 2*b*, etc., at the start of the $2N^{th}$ discharge pulse P2. In such a case, the landing positions of the $2N^{th}$ ones of the second ink dots 47*b*, etc., are shifted in the Y1 direction from those of the $2N-1^{th}$ ones of the second ink dots 47*b*, etc.

Moreover, while the first driving pulse P3*a* is shaped so that the landing positions of the $2N^{th}$ ones of the second ink dots 47*b*, etc., are shifted in the Y1 direction from those of the $2N-1^{th}$ ones of the second ink dots 47*b*, etc., in the present embodiment, the first driving pulse P3*a* may alternatively be shaped so that the landing positions of any other ones of the second ink dots 47*b*, etc., are shifted in the Y1 direction.

Moreover, while the first driving pulse P3*a* is shaped so that the landing positions of the $2N^{th}$ ones of the second ink dots 47*b*, etc., are shifted in the Y1 direction from those of the $2N-1^{th}$ ones of the second ink dots 47*b*, etc., in the present embodiment, the first driving pulse P3*a* may alternatively be shaped so that the shift is in the Y2 direction.

Moreover, the first and second driving pulses P3*a* and P3*b* are designed as described above in the present embodiment, the first and second driving pulses P3*a* and P3*b* may be of any other design as long as the first driving pulse P3*a* includes the preliminary pulse P1 and the discharge pulse P2.

Embodiment 2

An ink jet recording apparatus of the present embodiment performs a test recording operation before performing an actual recording operation by the ink jet recording apparatus, and shifts the landing positions of some ink dots. Other than this, the ink jet recording apparatus of the present embodiment is substantially the same as that of Embodiment 1. The ink jet recording apparatus of the present embodiment will now be described while focusing on what is different from Embodiment 1.

The pulse to be input as the driving pulse P3 by each switch circuit 31 to the corresponding piezoelectric actuator 10 is determined based on the results of a test recording operation to be described later. In the present embodiment, a third driving pulse P3*c* to be described later is input to the sixth piezoelectric actuator 10*f*. On the other hand, the second driving pulse P3*b* (see FIG. 8B) as described above is input to the first to fifth and seventh piezoelectric actuators 10*a*, 10*b*, 10*c*, 10*d*, 10*e* and 10*g*. Note that the sixth nozzle 2*f* corresponds to the "first nozzle" as used herein, and the first to fifth and seventh nozzles 2*a*, 2*b*, 2*c*, 2*d*, 2*e* and 2*g* correspond to the "second nozzle" as used herein.

Figure 11:
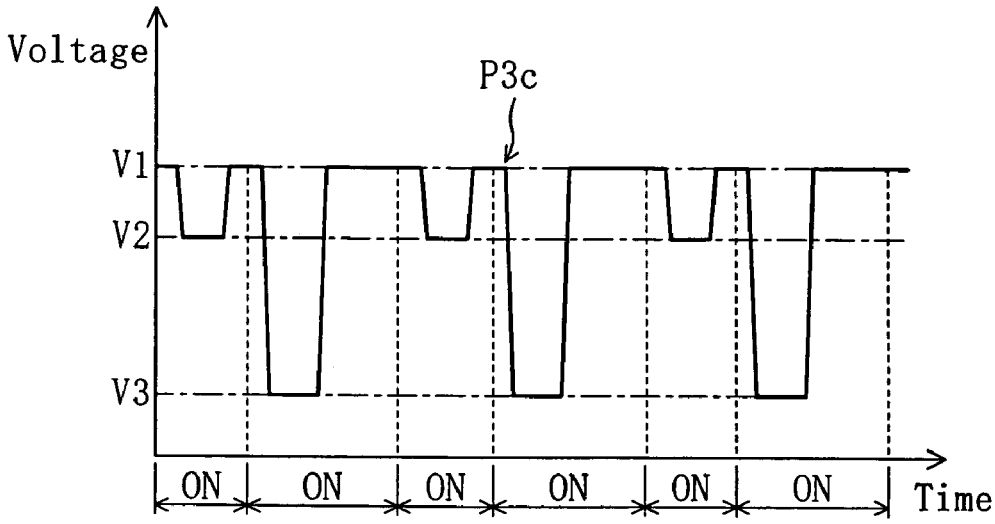
FIG. 11 is a waveform diagram illustrating a third driving pulse.

Specifically, the transistor of the sixth switch circuit 31*f* is turned ON throughout the entire period of the first reference pulse P4*a*, thereby producing the third driving pulse P3*c*, which is equal to the first reference pulse P4*a*, as illustrated in FIG. 11. Then, the sixth switch circuit 31*f* inputs the third driving pulse P3*c* to the sixth piezoelectric actuator 10*f*.

Thus, the switch circuits 31 selectively supply a driving pulse including the preliminary pulse P1 and the discharge pulse P2 in this order and a driving pulse including the discharge pulse P2 to the piezoelectric actuators 10.

Test Recording Operation of Ink Jet Recording Apparatus

Next, the test recording operation to be performed before the actual recording operation using the ink jet recording apparatus will be described.

Figure 12:
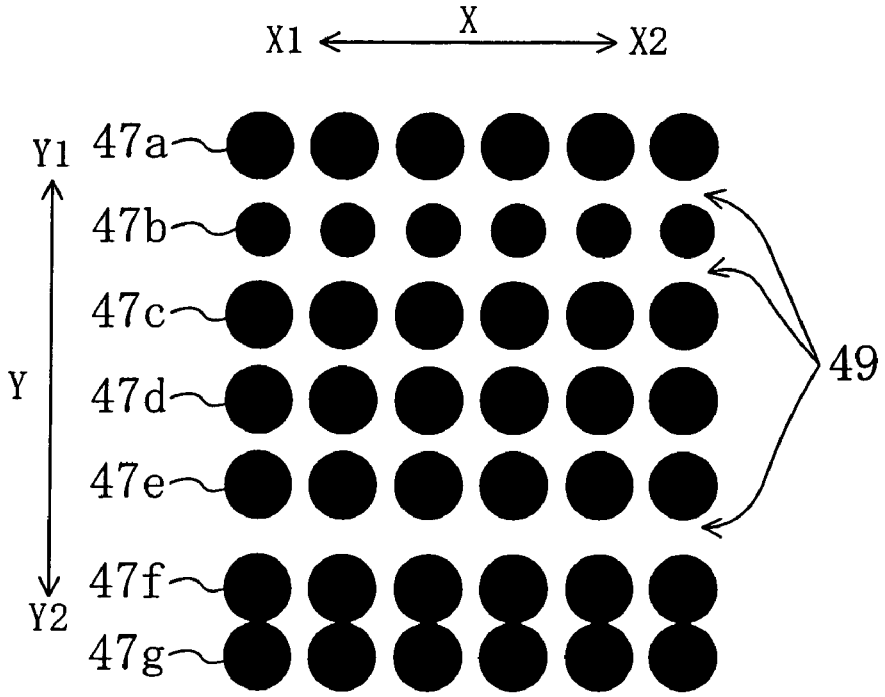
FIG. 12 is a diagram illustrating an ink dot pattern formed in a test recording operation.

First, the recording paper 41 is carried to a predetermined position by the carrier motor 26 and the carrier rollers 42, and the ink jet head 1 is carried from the position X1 to the position X2 along the carriage shaft 17. During this process, the reference pulse generation circuit 30 generates the first reference pulse P4*a* at a predetermined cycle. Then, the first to seventh switch circuits 31*a*, 31*b*, 31*c*, 31*d*, 31*e*, 31*f* and 31*g* produce the second driving pulse P3*b* from the first reference pulse P4*a* and input the second driving pulse P3*b* to the first to seventh piezoelectric actuators 10*a*, 10*b*, 10*c*, 10*d*, 10*e*, 10*f* and 10*g*, respectively, thereby discharging ink droplets from the first to seventh nozzles 2*a*, 2*b*, 2*c*, 2*d*, 2*e*, 2*f* and 2*g*, respectively, of the ink jet head 1. In this way, the ink droplets discharged from the first to seventh nozzles 2*a*, 2*b*, 2*c*, 2*d*, 2*e*, 2*f* and 2*g* land on the recording paper 41, thereby forming the first to seventh ink dots 47*a*, 47*b*, 47*c*, 47*d*, 47*e*, 47*f* and 47*g*, respectively, as illustrated in FIG. 12. Thus, a test recording image for one scan of the ink jet head 1 is recorded on the recording paper 41.

It can be seen from the test recording image that the diameter of the second ink dots 47*b* is smaller than those of the other ink dots 47*a*, 47*c*, 47*d*, 47*e*, 47*f* and 47*g*. It can also be seen that the landing positions of the sixth ink dots 47*f* are shifted downwardly (in the Y2 direction) from those of the other ink dots 47*a*, 47*b*, 47*c*, 47*d*, 47*e* and 47*g*. As a result, a white streak 49 extending in the primary scanning direction X appears between the first ink dots 47*a* and the second ink dots 47*b*, between the second ink dots 47*b* and the third ink dots 47*c*, and between the fifth ink dots 47*e* and the sixth ink dots 47*f*. Therefore, when performing an actual recording operation using the ink jet recording apparatus, the third driving pulse P3*c* is input to the sixth piezoelectric actuator 10*f*. On the other hand, the second driving pulse P3*b* is input to the first to fifth and seventh piezoelectric actuators 10*a*, 10*b*, 10*c*, 10*d*, 10*e* and 10*g*.

Actual Recording Operation of Ink Jet Recording Apparatus

Next, the actual recording operation using the ink jet recording apparatus will be described.

First, the recording paper 41 is carried to a predetermined position by the carrier motor 26 and the carrier rollers 42, and the ink jet head 1 is carried from the position X1 to the position X2 along the carriage shaft 17. During this process, the reference pulse generation circuit 30 generates the first reference pulse P4*a* at a predetermined cycle. Then, the sixth switch circuit 31*f* inputs the third driving pulse P3*c* to the corresponding piezoelectric actuator. On the other hand, the first to fifth and seventh switch circuits 31*a*, 31*b*, 31*c*, 31*d*, 31*e* and 31*g* input the second driving pulse P3*b* to the corresponding piezoelectric actuators.

Figure 13:
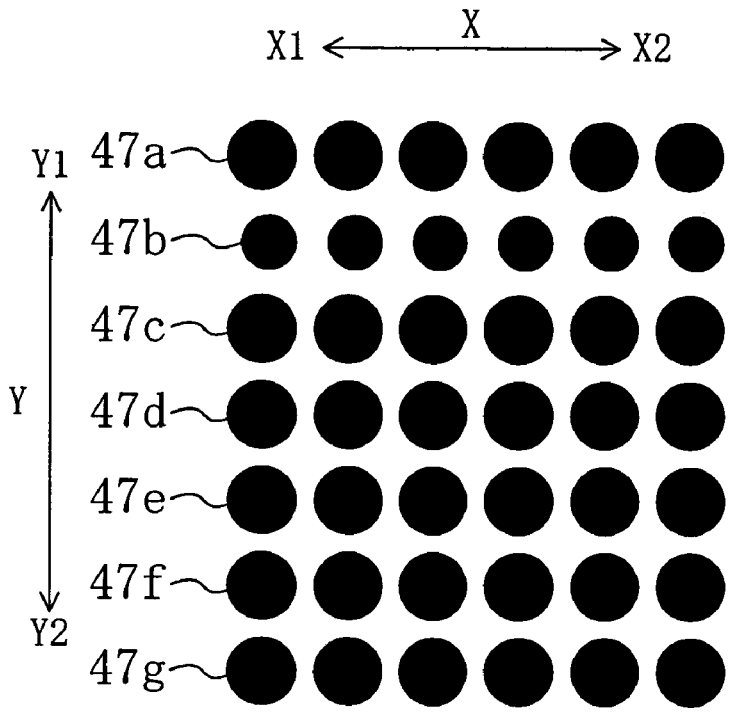
FIG. 13 is a diagram illustrating an ink dot pattern formed in an actual recording operation.

The ink meniscus 45 in the tip portion of the sixth nozzle 2*f* undergoes a damped vibration as described above, as illustrated in FIG. 9, upon receiving the preliminary pulse P1 of the third driving pulse P3*c*. The third driving pulse P3*c* is shaped so that the cross section of the ink meniscus 45 perpendicular to the primary scanning direction X is asymmetric about the axis A of the sixth nozzle 2*f* at the start of the discharge pulse P2 of the third driving pulse P3*c*, and so that the landing positions of the sixth ink dots 47*f* in the actual recording operation are shifted in the Y1 direction from those of the sixth ink dots 47*f* of the test recording image. Therefore, the direction in which ink droplets are discharged from the sixth nozzle 2*f* upon receiving the discharge pulse P2 of the third driving pulse P3*c* changes. Thus, as illustrated in FIG. 13, the landing positions of the sixth ink dots 47*f* in the actual recording operation are shifted in the Y1 direction from those of the sixth ink dots 47*f* of the test recording image.

Thus, the white streak 49 extending in the primary scanning direction X between the fifth ink dots 47*e* and the sixth ink dots 47*f* in the test recording image disappears.

According to the present embodiment, as the sixth switch circuit 31*f* inputs the preliminary pulse P1 of the third driving pulse P3*c*, the cross section, perpendicular to the primary scanning direction X, of the ink meniscus 45 in the tip portion of the sixth nozzle 2*f* is made asymmetric about the axis A of the sixth nozzle 2*f*. Therefore, by inputting the third driving pulse P3*c*, ink droplets are discharged from the sixth nozzle 2*f* in a direction inclined from the axis A of the sixth nozzle 2*f*. Thus, the landing positions of the sixth ink dots 47*f* in the actual recording operation are shifted in the Y1 direction from those of the sixth ink dots 47*f* of the test recording image. Therefore, it is possible to prevent the white streak 49 extending in the primary scanning direction X from appearing on the recording paper 41 between the fifth ink dots 47*e* and the sixth ink dots 47*f*.

Embodiment 3

An ink jet recording apparatus of the present embodiment performs a test recording operation before performing an actual recording operation by the ink jet recording apparatus, and changes the diameter of the ink dots. Other than this, the ink jet recording apparatus of the present embodiment is substantially the same as that of Embodiment 1. The ink jet recording apparatus of the present embodiment will now be described while focusing on what is different from Embodiment 1.

Figure 14:
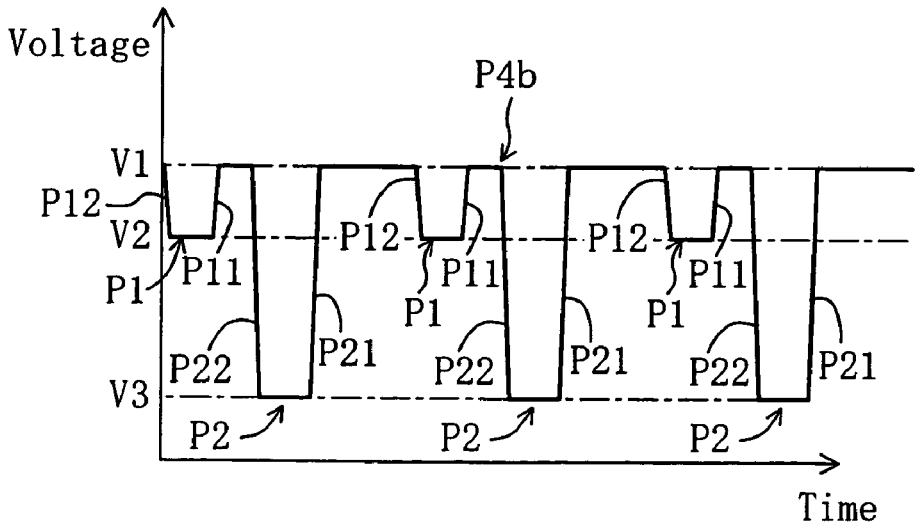
FIG. 14 is a waveform diagram illustrating a second reference pulse.

As illustrated in FIG. 14, the second reference pulse P4*b* includes the preliminary pulses P1 and the discharge pulses P2 alternating with each other.

The pulse to be input as the driving pulse P3 by each switch circuit 31 to the corresponding piezoelectric actuator 10 is determined based on the results of a test recording operation to be described later. In the present embodiment, a fourth driving pulse P3*d* to be described later is input to the second piezoelectric actuator 10*b*. On the other hand, a fifth driving pulse P3*e* to be described later is input to the first and third to seventh piezoelectric actuators 10*a*, 10*c*, 10*d*, 10*e*, 10*f* and 10*g*. Note that the second nozzle 2*b* corresponds to the "first nozzle" as used herein, and the first and third to seventh nozzles 2*a*, 2*c*, 2*d*, 2*e*, 2*f* and 2*g* correspond to the "second nozzle" as used herein.

Figure 15A:
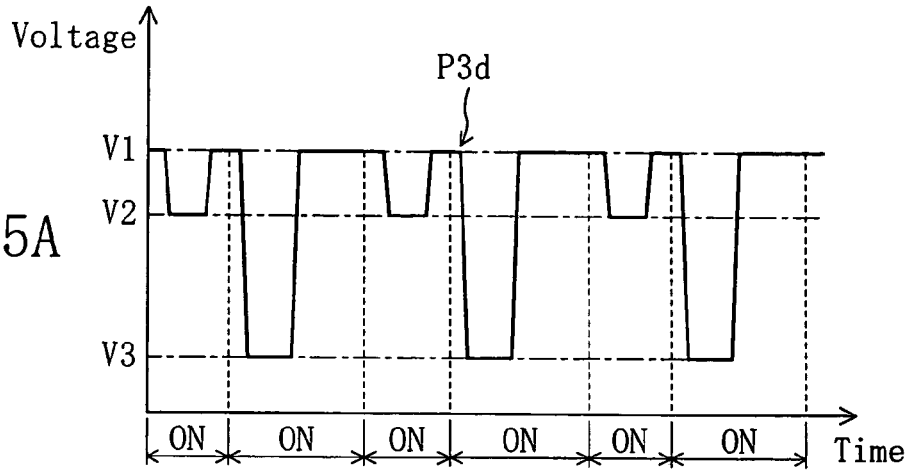
FIG. 15A is a waveform diagram illustrating a fourth driving pulse.

Specifically, the transistor of the second switch circuit 31*b* is turned ON throughout the entire period of the fourth reference pulse P4*b*, thereby producing the third driving pulse P3*d*, which is equal to the fourth reference pulse P4*b*, as illustrated in FIG. 15A. Then, the second switch circuit 31*b* inputs the fourth driving pulse P3*d* to the second piezoelectric actuator 10*b*.

Figure 15B:
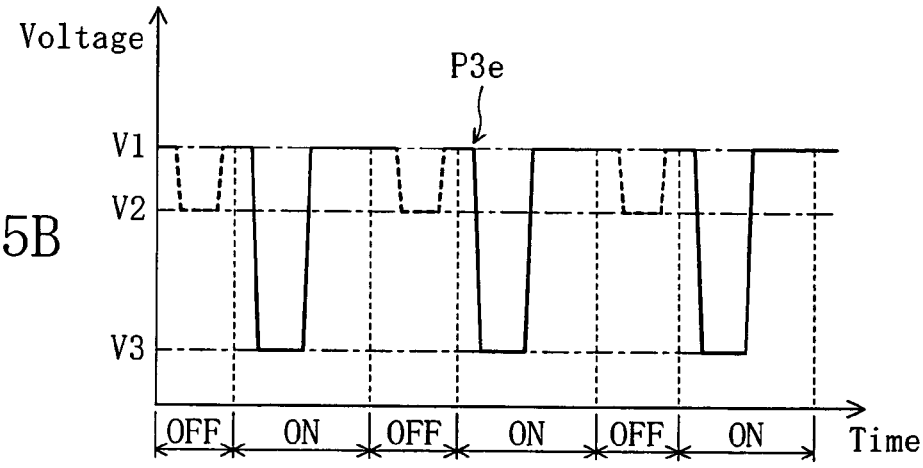
FIG. 15B is a waveform diagram illustrating a fifth driving pulse.

On the other hand, the transistors of the first and third to seventh switch circuits 31*a*, 31*c*, 31*d*, 31*e*, 31*f* and 31*g* are turned OFF while the preliminary pulse P1 of the second reference pulse P4*b* is being output, thereby producing the fifth driving pulse P3*e*, as illustrated in FIG. 15B. Then, the first and third to seventh switch circuits 31*a*, 31*c*, 31*d*, 31*e*, 31*f* and 31*g* input the fifth driving pulse P3*e* to the first and third to seventh piezoelectric actuators 10*a*, 10*c*, 10*d*, 10*e*, 10*f* and 10*g*, respectively.

Thus, the switch circuits 31 selectively supply a driving pulse including the preliminary pulse P1 and the discharge pulse P2 in this order and a driving pulse including the discharge pulse P2 to the piezoelectric actuators 10.

Test Recording Operation of Ink Jet Recording Apparatus

Next, the test recording operation to be performed before the actual recording operation using the ink jet recording apparatus will be described.

First, a test recording image for one scan of the ink jet head 1 is recorded on the recording paper 41, as described above.

It can be seen from the test recording image illustrated in FIG. 12 that the diameter of the second ink dots 47*b* is smaller than those of the other ink dots 47*a*, 47*c*, 47*d*, 47*e*, 47*f* and 47*g*. It can also be seen that the landing positions of the sixth ink dots 47*f* are shifted downwardly (in the Y2 direction) from those of the other ink dots 47*a*, 47*b*, 47*c*, 47*d*, 47*e* and 47*g*. As a result, the white streak 49 extending in the primary scanning direction X appears between the first ink dots 47*a* and the second ink dots 47*b*, between the second ink dots 47*b* and the third ink dots 47*c*, and between the fifth ink dots 47*e* and the sixth ink dots 47*f*. Therefore, when performing an actual recording operation using the ink jet recording apparatus, the fourth driving pulse P3*d* is input to the second piezoelectric actuator 10*b*. On the other hand, the fifth driving pulse P3*e* is input to the first and third to seventh piezoelectric actuators 10*a*, 10*c*, 10*d*, 10*e*, 10*f* and 10*g*.

Actual Recording Operation of Ink Jet Recording Apparatus

Next, the actual recording operation using the ink jet recording apparatus will be described.

First, the recording paper 41 is carried to a predetermined position by the carrier motor 26 and the carrier rollers 42, and the ink jet head 1 is carried from the position X1 to the position X2 along the carriage shaft 17. During this process, the reference pulse generation circuit 30 generates the second reference pulse P4*b* at a predetermined cycle. Then, the second switch circuit 31*b* inputs the fourth driving pulse P3*d* to the corresponding piezoelectric actuator. On the other hand, the first and third to seventh switch circuits 31*a*, 31*c*, 31*d*, 31*e*, 31*f* and 31*g* input the fifth driving pulse P3*e* to the corresponding piezoelectric actuators.

Figure 16:
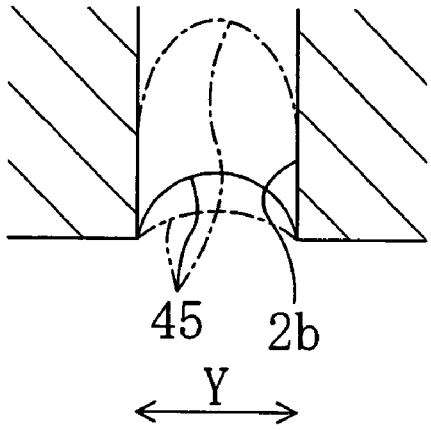
FIG. 16 is an enlarged cross-sectional view illustrating a portion around a nozzle, showing how an ink meniscus changes.
Figure 17:
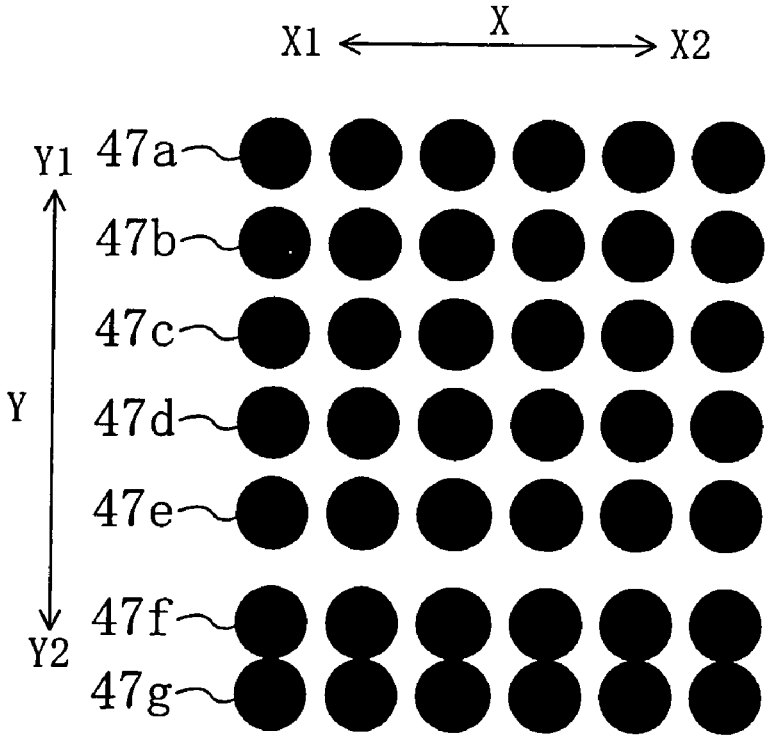
FIG. 17 is a diagram illustrating an ink dot pattern formed in an actual recording operation.

The ink meniscus 45 in the tip portion of the second nozzle 2*b* undergoes a damped vibration as described above, as illustrated in FIG. 16, upon receiving the preliminary pulse P1 of the fourth driving pulse P3*d*. The fourth driving pulse P3*d* is shaped so that the ink meniscus 45 is displaced from the reference position toward the tip of the nozzle 2 at the start of the discharge pulse P2 of the fourth driving pulse P3*d*. Therefore, by inputting the discharge pulse P2 of the fourth driving pulse P3*d*, the volume of the ink droplet discharged from the second nozzle 2*b* is increased from that when the second driving pulse P3*b* is input. Thus, the diameter of the second ink dots 47*b* in the actual recording operation is larger than that in the test recording image as illustrated in FIG. 17.

Thus, the white streaks 49 extending in the primary scanning direction X between the first ink dots 47*a* and the second ink dots 47*b* and between the second ink dots 47*b* and the third ink dots 47*c* in the test recording image disappear.

According to the present embodiment, as the second switch circuit 31*b* inputs the preliminary pulse P1 of the fourth driving pulse P3*d*, the ink meniscus 45 in the tip portion of the second nozzle 2*b* vibrates, whereby the diameter of the second ink dots 47*b* in the actual recording operation is larger than that in the test recording image. Therefore, it is possible to prevent the white streaks 49 extending in the primary scanning direction X from appearing on the recording paper 41 between the first ink dots 47*a* and the second ink dots 47*b* and between the second ink dots 47*b* and the third ink dots 47*c*. Moreover, it is no longer necessary to perform N-pass recording as in the prior art, whereby it is possible to prevent a decrease in the recording speed. Thus, it is possible to prevent the white streak 49 extending in the primary scanning direction X from appearing on the recording paper 41 while preventing a decrease in the recording speed.

Embodiment 4

In an ink jet recording apparatus of the present embodiment, the cross section, perpendicular to the primary scanning direction, of an ink channel portion including a nozzle and a pressure chamber is asymmetric about the symmetry axis of the pressure chamber. Other than this, the ink jet recording apparatus of the present embodiment is substantially the same as that of Embodiment 1. The ink jet recording apparatus of the present embodiment will now be described while focusing on what is different from Embodiment 1.

Figure 18:
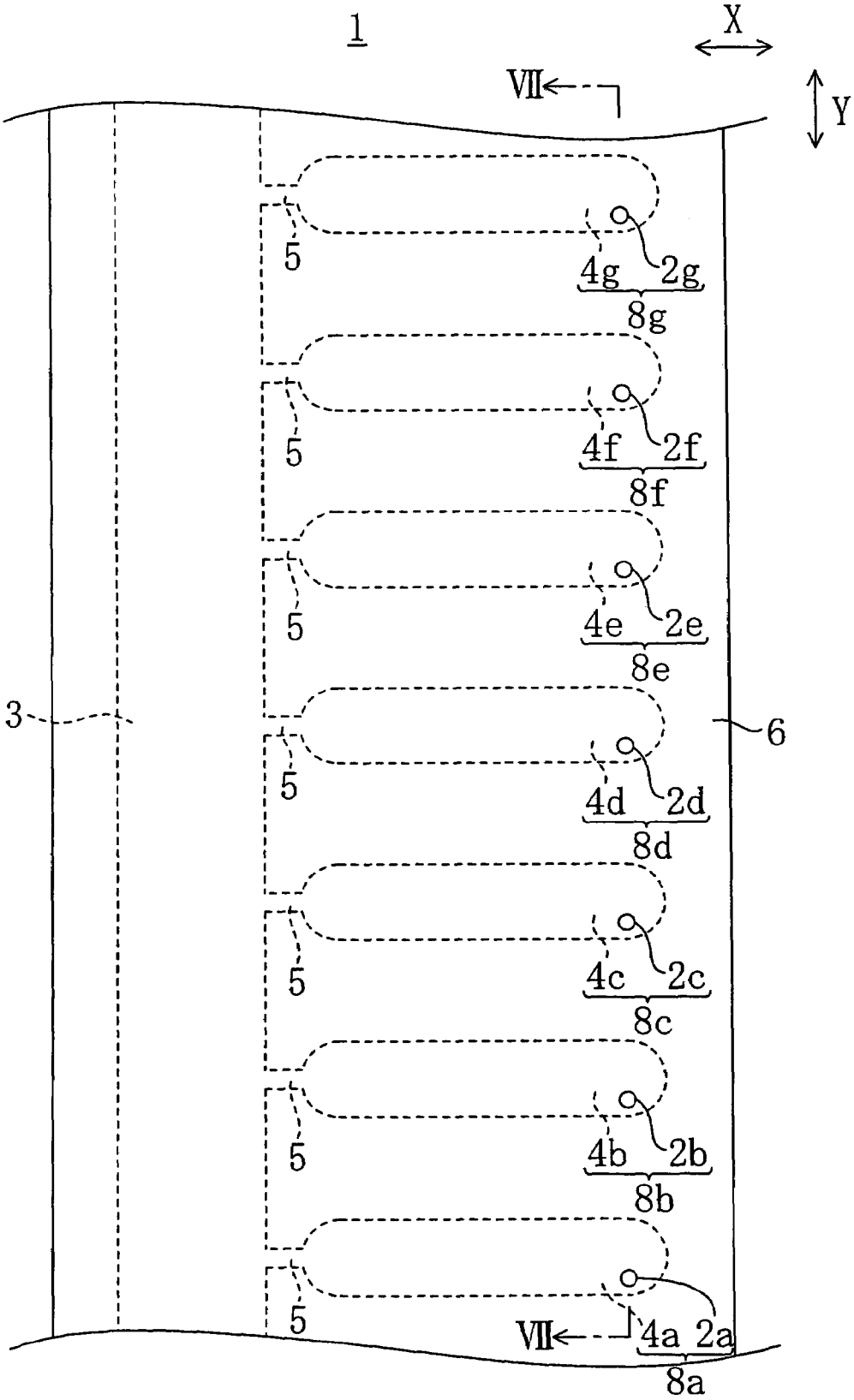
FIG. 18 is a diagram illustrating a portion of a bottom surface of an ink jet head.
Figure 19:
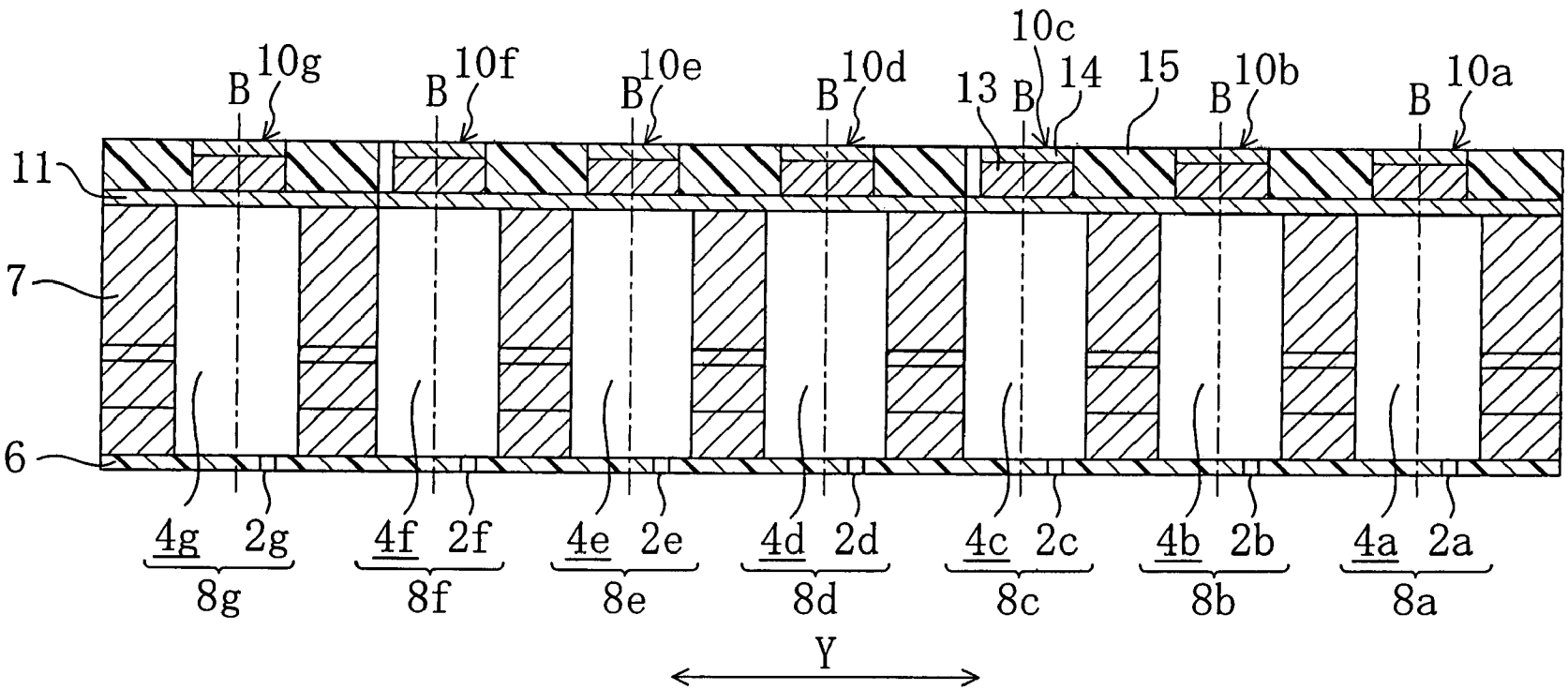
FIG. 19 is a cross-sectional view taken along line VII—VII of FIG. 18.

As illustrated in FIG. 18 and FIG. 19, the cross section (perpendicular to the primary scanning direction X) of each of first to seventh ink channel portions 8*a*, 8*b*, 8*c*, 8*d*, 8*e*, 8*f* and 8*g* including the first to seventh nozzles 2*a*, 2*b*, 2*c*, 2*d*, 2*e*, 2*f* and 2*g* and the first to seventh pressure chambers 4*a*, 4*b*, 4*c*, 4*d*, 4*e*, 4*f* and 4*g*, respectively, is asymmetric about the symmetry axis B (see FIG. 19) of the pressure chamber 4. Specifically, as illustrated in FIG. 18, the first to seventh nozzles 2*a*, 2*b*, 2*c*, 2*d*, 2*e*, 2*f* and 2*g* are each located near the lower edge of the pressure chamber 4 on the bottom surface of the ink jet head 1. Moreover, as illustrated in FIG. 19, the first to seventh nozzles 2*a*, 2*b*, 2*c*, 2*d*, 2*e*, 2*f* and 2*g* are each located near the right edge of the pressure chamber 4 on the bottom surface of the ink jet head 1.

According to the present embodiment, the first to seventh nozzles 2*a*, 2*b*, 2*c*, 2*d*, 2*e*, 2*f* and 2*g* are each located near the right edge of the pressure chamber 4 on the bottom surface of the ink jet head 1, whereby as the second, fourth and sixth switch circuits 31*b*, 31*d* and 31*f* input the preliminary pulse P1 to the second, fourth and sixth piezoelectric actuators 10*b*, 10*d* and 10*f*, respectively, the cross section, perpendicular to the primary scanning direction X, of the ink meniscus 45 in the tip portion of the second, fourth and sixth nozzles 2*b*, 2*d* and 2*f* is reliably made asymmetric about the axis A of the nozzle 2. Therefore, the landing positions of the 2N ones of the second, fourth and sixth ink dots 47*b*, 47*d* and 47*f* can reliably be shifted in the Y1 direction from those of the $2N-1^{th}$ ones of the second, fourth and sixth ink dots 47*b*, 47*d* and 47*f*.

Figure 20A:
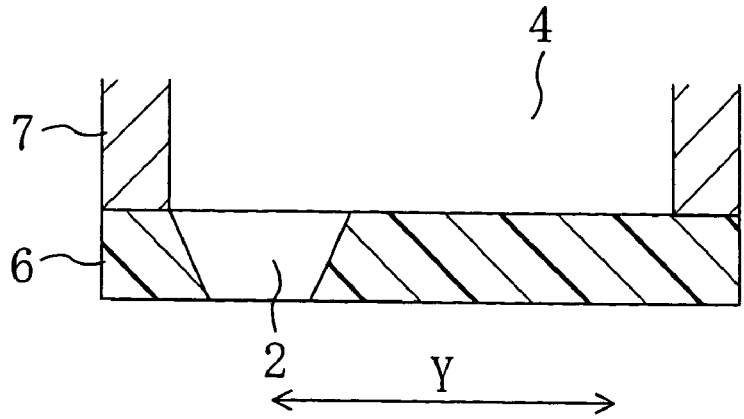
FIG. 20A is an enlarged cross-sectional view illustrating a portion around a nozzle and a pressure chamber.
Figure 20B:
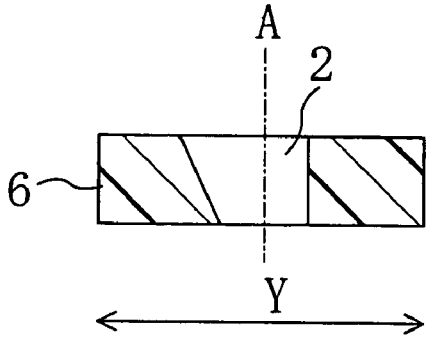
FIG. 20B is an enlarged cross-sectional view illustrating a portion around a nozzle.
Figure 20C:
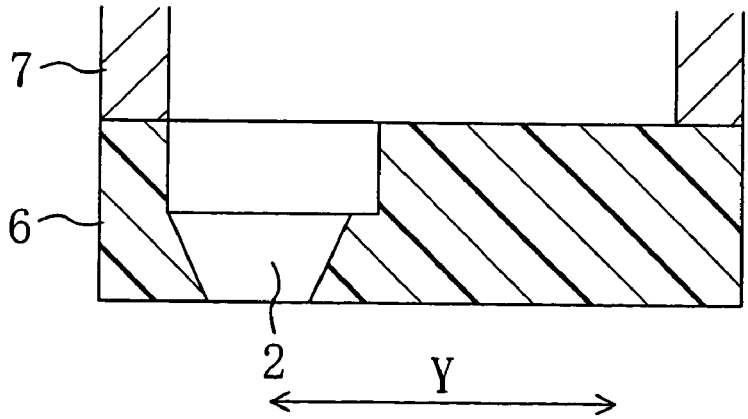
FIG. 20C is an enlarged cross-sectional view illustrating a portion around a nozzle and a pressure chamber.

Note that while the first to seventh nozzles 2*a*, 2*b*, 2*c*, 2*d*, 2*e*, 2*f* and 2*g* are each located near the right edge of the pressure chamber 4 on the bottom surface of the ink jet head 1 in the present embodiment, they may alternatively be located near the left edge of the pressure chamber 4 on the bottom surface of the ink jet head 1, as illustrated in FIG. 20A. Alternatively, the cross section of the nozzle 2 itself perpendicular to the primary scanning direction X may be asymmetric about the axis A of the nozzle 2, as illustrated in FIG. 20B. Alternatively, each nozzle 2 may be located near the left edge of the pressure chamber 4 on the bottom surface of the ink jet head 1 with a lower portion of the nozzle 2 being shifted to the left with respect to an upper portion thereof, as illustrated in FIG. 20C.

Embodiment 5

An ink jet recording apparatus of the present embodiment turns ON/OFF the switch circuits for every printing period. Other than this, the ink jet recording apparatus of the present embodiment is substantially the same as that of Embodiment 1. The ink jet recording apparatus of the present embodiment will now be described while focusing on what is different from Embodiment 1.

Figure 21:
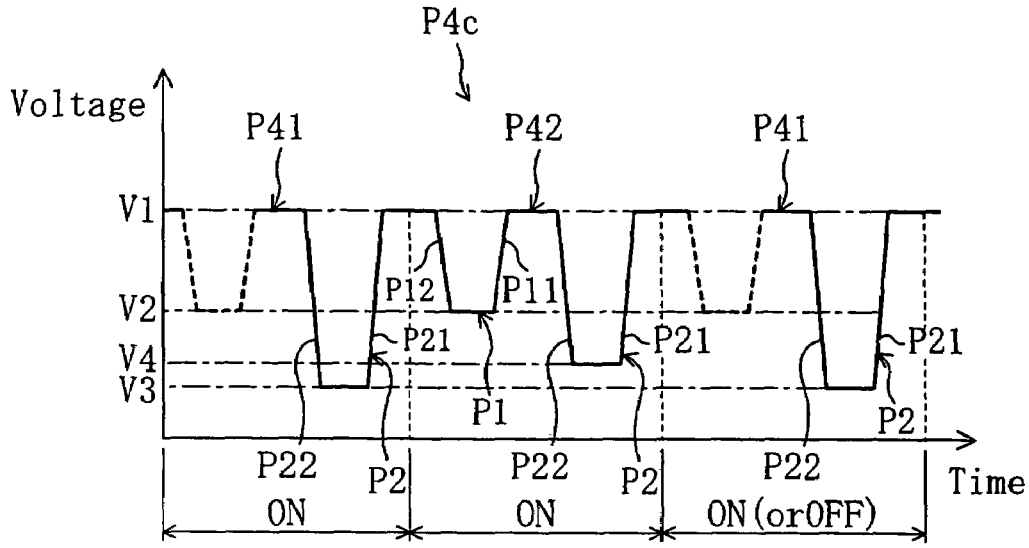
FIG. 21 is a waveform diagram illustrating a third reference pulse.

The reference pulse generation circuit 30 generates a third reference pulse P4*c* (see FIG. 21).

As illustrated in FIG. 21, the third reference pulse P4*c* includes first component pulses P41 and second component pulses P42 alternating with each other. The first component pulse P41 includes the discharge pulse P2, and the second component pulse P42 includes the preliminary pulse P1 and the discharge pulse P2 in this order. Note that the period in which the second component pulse P42 is input to the piezoelectric actuator 10 corresponds to the "predetermined printing period" as used herein, and the period in which the first component pulse P41 is input to the piezoelectric actuator 10 corresponds to the "printing period different from the predetermined printing period" as used herein. Moreover, the second component pulse P42 corresponds to the "first reference pulse" as used herein, and the first component pulse P41 corresponds to the "second reference pulse" as used herein.

The amplitude VI–V3 of the discharge pulse P2 of the first component pulse P41 is different from the amplitude V1–V4 of the discharge pulse P2 of the second component pulse P42. Specifically, the amplitude V1–V4 of the discharge pulse P2 of the second component pulse P42 is smaller than the amplitude V1–V3 of the discharge pulse P2 of the first component pulse P41. Furthermore, the gradient of the rising waveform P21 of the discharge pulse P2 of the first component pulse P41 is different from that of the rising waveform P21 of the discharge pulse P2 of the second component pulse P42. Specifically, the gradient of the rising waveform P21 of the discharge pulse P2 of the second component pulse P42 is larger than that of the rising waveform P21 of the discharge pulse P2 of the first component pulse P41.

While the ink jet head 1 is moving in the primary scanning direction, the first to seventh switch circuits 31*a*, 31*b*, 31*c*, 31*d*, 31*e*, 31*f* and 31*g* are each turned ON for every printing period, thereby producing the driving pulse P3, which is equal to the third reference pulse P4*c*, and the driving pulse P3 is input to the first to seventh piezoelectric actuators 10*a*, 10*b*, 10*c*, 10*d*, 10*e*, 10*f* and 10*g*. In other words, in the present embodiment, switching of the switch circuit 31 needs to be performed only once to form one pixel (one ink dot 47).

Figure 22:
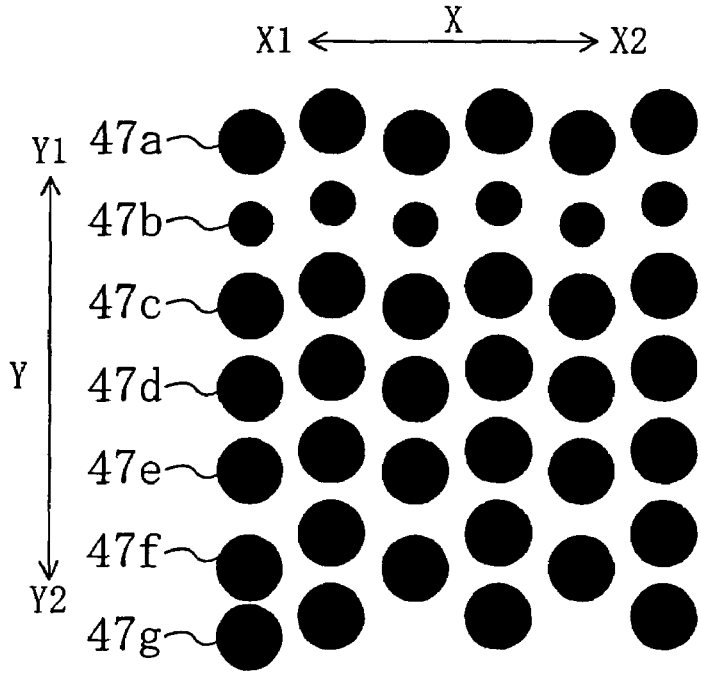
FIG. 22 is a diagram illustrating an ink dot pattern formed in an actual recording operation.

Thus, as illustrated in FIG. 22, the landing positions of the first to seventh ink dots 47*a*, 47*b*, 47*c*, 47*d*, 47*e*, 47*f* and 47*g* (the $2N^{th}$ ones of the first to seventh ink dots 47*a*, 47*b*, 47*c*, 47*d*, 47*e*, 47*f* and 47*g* in FIG. 22) when the second component pulse P42 is input from the first to seventh switch circuits 31*a*, 31*b*, 31*c*, 31*d*, 31*e*, 31*f* and 31*g* to the first to seventh piezoelectric actuators 10*a*, lo*b*, 10*c*, 10*d*, 10*e*, 10*f* and 10*g*, respectively, are shifted in the Y1 direction from those of the first to seventh ink dots 47*a*, 47*b*, 47*c*, 47*d*, 47*e*, 47*f* and 47*g* (the $2N-1^{th}$ ones of the first to seventh ink dots 47*a*, 47*b*, 47*c*, 47*d*, 47*e*, 47*f* and 47*g* in FIG. 22) when the first component pulse P41 is input.

According to the present embodiment, the first component pulse P41 is input from the first to seventh switch circuits 31*a*, 31*b*, 31*c*, 31*d*, 31*e*, 31*f* and 31*g* to the first to seventh piezoelectric actuators 10*a*, 10*b*, 10*c*, 10*d*, 10*e*, 10*f* and 10*g*, respectively, in a predetermined printing period, whereas the second component pulse P42 is input in the next printing period following the predetermined printing period, whereby it is possible to prevent a white streak extending in the primary scanning direction X from appearing on the recording paper 41 due to a defect of the ink jet head 1, etc.

Moreover, since the third reference pulse P4*c* includes the first component pulses P41 (each including the discharge pulse P2) and the second component pulses P42 (each including the preliminary pulse P1 and the discharge pulse P2 in this order) alternating with each other, each switch circuit 31 can produce the driving pulse P3 by turning ON/OFF the switch circuit 31 for every printing period. Therefore, the driving pulse P3 can easily be produced in the switch circuit 31, whereby the structure of the switch circuit 31 can be simplified.

When the second component pulse P42 is input from the switch circuit 31 to the piezoelectric actuator 10, the volume of the ink droplet discharged from the nozzle 2 may be increased and the ink discharging velocity may be decreased as compared with when the first component pulse P41 is input.

In the present embodiment, the amplitude V1–V4 of the discharge pulse P2 of the second component pulse P42 is smaller than the amplitude V1–V3 of the discharge pulse P2 of the first component pulse P41 so as to correct the difference between the volume of the ink droplet discharged from the nozzle 2 when the second component pulse P42 is input and that when the first component pulse P41 is input. Therefore, the volume of the ink droplet discharged from the nozzle 2 by inputting the first component pulse P41 can be made uniform with that when the second component pulse P42 is input.

Moreover, the gradient of the rising waveform P21 of the discharge pulse P2 of the second component pulse P42 is larger than that of the rising waveform P21 of the discharge pulse P2 of the first component pulse P41 so as to correct the difference between the ink discharging velocity when the second component pulse P42 is input and that when the first component pulse P41 is input. Therefore, the ink discharging velocity when the second component pulse P42 is input can be made uniform with that when the first component pulse P41 is input. Thus, it is possible to prevent an image non-uniformity from appearing on the recording paper 41 due to the input of the second component pulse P42.

Note that while the third reference pulse P4*c* includes the first component pulses P41 and the second component pulses P42 alternating with each other in the present embodiment, the third reference pulse P4*c* is not limited to this as long as it includes the second component pulse P42.

Moreover, while the gradient of the rising waveform P21 of the discharge pulse P2 of the second component pulse P42 is larger than that of the rising waveform P21 of the discharge pulse P2 of the first component pulse P41 in the present embodiment, the gradient of the falling waveform P22 of the discharge pulse P2 of the second component pulse P42 may alternatively be smaller than that of the falling waveform P22 of the discharge pulse P2 of the first component pulse P41.

Moreover, in the present embodiment, the amplitude V1–V4 of the discharge pulse P2 of the second component pulse P42 is smaller than the amplitude V1–V3 of the discharge pulse P2 of the first component pulse P41, and the gradient of the rising waveform P21 of the discharge pulse P2 of the second component pulse P42 is larger than that of the rising waveform P21 of the discharge pulse P2 of the first component pulse P41. However, where the volume of the ink droplet is decreased and the ink discharging velocity is improved by inputting the second component pulse P42 as compared with those obtained by inputting the first component pulse P41, the amplitude V1–V4 of the discharge pulse P2 of the second component pulse P42 may be larger than the amplitude V1–V3 of the discharge pulse P2 of the first component pulse P41, and the gradient of the rising waveform P21 of the discharge pulse P2 of the second component pulse P42 may be smaller than that of the rising waveform P21 of the discharge pulse P2 of the first component pulse P41.

Embodiment 6

In an ink jet recording apparatus of the present embodiment, the amplitude of a preliminary pulse is equal to that of the discharge pulse, and the pulse width of the preliminary pulse is 1/40 to 1/5 of the Helmholtz period of the head. Other than this, the ink jet recording apparatus of the present embodiment is substantially the same as that of Embodiment 4. The ink jet recording apparatus of the present embodiment will now be described while focusing on what is different from Embodiment 4.

Figure 23:
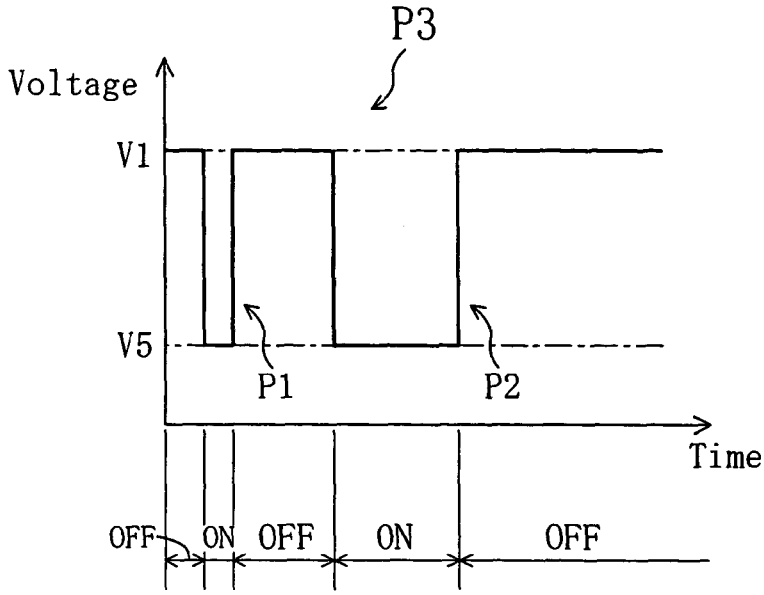
FIG. 23 is a waveform diagram illustrating a driving pulse.

As illustrated in FIG. 23, the preliminary pulse P1 and the discharge pulse P2 of the driving pulse P3 are rectangular. The amplitude V1–V5 of the preliminary pulse P1 is equal to the amplitude V1–V5 of the discharge pulse P2. The pulse width of the preliminary pulse P1 is 1/40 to 1/5 of the Helmholtz period of the head. The pulse width of the discharge pulse P2 is preferably 1/2 of the Helmholtz period of the head so as to make sufficient use of the produced resonance.

According to the present embodiment, the amplitude V1–V5 of the preliminary pulse P1 is equal to the amplitude V1–V5 of the discharge pulse P2, whereby the driving pulse P3 can be produced simply by turning ON/OFF a constant voltage by the switch circuit 31, as illustrated in FIG. 23. Therefore, the driving pulse P3 can easily be produced.

Moreover, since the pulse width of the preliminary pulse P1 is equal to or greater than 1/40 of the Helmholtz period of the head, the ink meniscus 45 in the tip portion of the nozzle 2 can be vibrated by inputting the preliminary pulse P1 from the switch circuit 31 to the piezoelectric actuator 10. Moreover, since the pulse width of the preliminary pulse P1 is less than or equal to 1/5 of the Helmholtz period of the head, an ink droplet is not discharged from the nozzle 2 when the preliminary pulse P1 is input from the switch circuit 31 to the piezoelectric actuator 10. Thus, one or both of the diameter and the landing position of the ink dot 47 can reliably be changed by inputting the driving pulse P3 from the switch circuit 31 to the piezoelectric actuator 10.

Note that in the present embodiment, the driving pulse P3 can be input to the piezoelectric actuator 10 simply by turning ON/OFF a constant voltage by the switch circuit 31, whereby it is not necessary to provide the reference pulse generation circuit 30 separately.

Embodiment 7

In an ink jet recording apparatus of the present embodiment, a preliminary pulse is used as a preliminary vibration pulse. Other than this, the ink jet recording apparatus of the present embodiment is substantially the same as that of Embodiment 1. The ink jet recording apparatus of the present embodiment will now be described while focusing on what is different from Embodiment 1.

Figure 24:
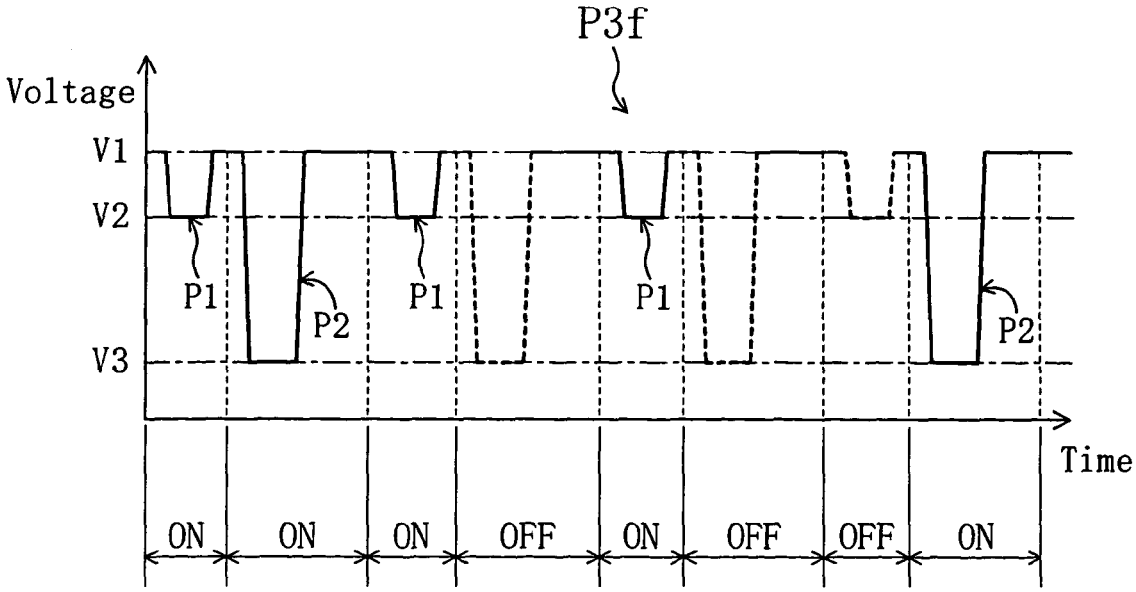
FIG. 24 is a waveform diagram illustrating a sixth driving pulse.

As illustrated in FIG. 24, the second, fourth and sixth switch circuits 31*b*, 31*d* and 31*f* are turned OFF while the second and third discharge pulses P2 and the fourth preliminary pulse P1 are being output, thereby producing a sixth driving pulse P3*f*. Then, the second, fourth and sixth switch circuits 31*b*, 31*d* and 31*f* input the sixth driving pulse P3*f* to the second, fourth and sixth piezoelectric actuators 10*b*, 10*d* and 10*f*, respectively. Note that the second preliminary pulse P1 and the third preliminary pulse P1 correspond to the "third driving pulse" as used herein.

The second and third preliminary pulses P1 are used as preliminary vibration pulses. A preliminary vibration pulse is a pulse used for preventing ink in the pressure chamber 4 from becoming dry with an increase in its viscosity.

According to the present embodiment, the second, fourth and sixth switch circuits 31*b*, 31*d* and 31*f* input the sixth driving pulse P3*f* to the second, fourth and sixth piezoelectric actuators 10*b*, 10*d* and 10*f*, respectively, whereby the second and third preliminary pulses P1 can be used as preliminary vibration pulses. Therefore, it is possible to prevent ink in the pressure chamber 4 from becoming dry with an increase in its viscosity.

Note that the second and third preliminary pulses P1 are used as preliminary vibration pulses in the present embodiment, any other preliminary pulse P1 may alternatively be used as a preliminary vibration pulse.

Embodiment 8

In an ink jet recording apparatus of the present embodiment, a switch circuit supplies the first, second and third ones of the "first driving pulses" as used herein in this order so that the interval between the first one and the second one of the first driving pulses is different from that between the second one and the third one of the first driving pulses. Other than this, the ink jet recording apparatus of the present embodiment is substantially the same as that of Embodiment 1. The ink jet recording apparatus of the present embodiment will now be described while focusing on what is different from Embodiment 1.

Figure 25:
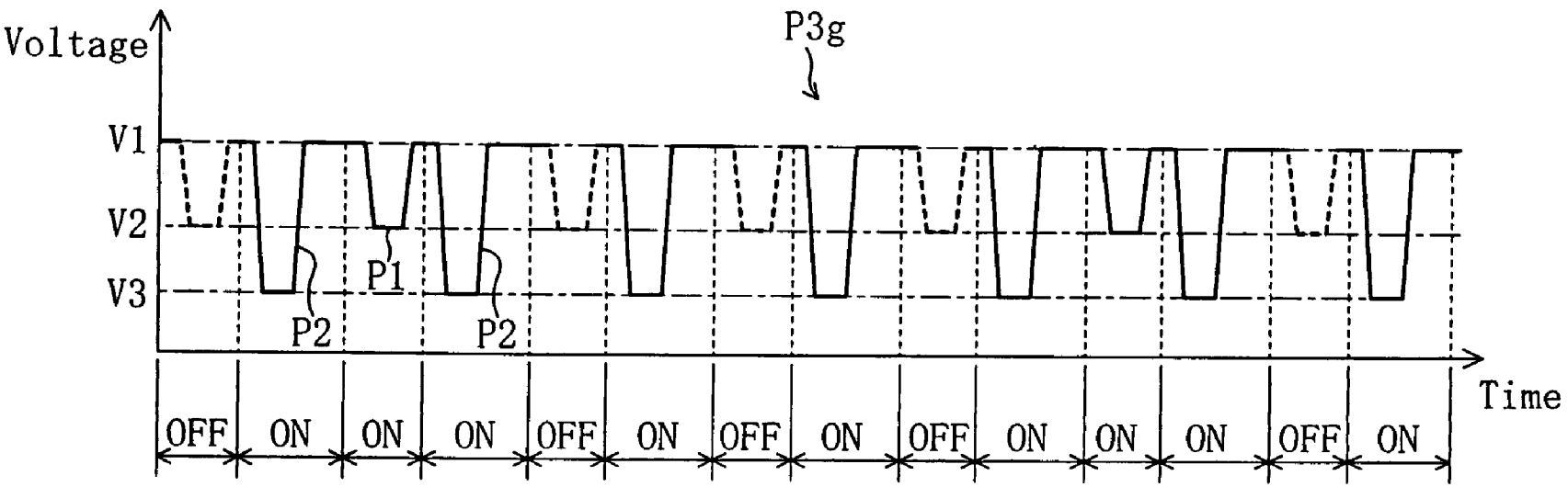
FIG. 25 is a waveform diagram illustrating a seventh driving pulse.

As illustrated in FIG. 25, the second, fourth and sixth switch circuits 31*b*, 31*d* and 31*f* are turned OFF while the preliminary pulses P1 other than the $6N-4^{th}$ and $6N^{th}$ (N is a natural number) ones thereof (i.e., the first, third, fourth, fifth, seventh, . . . , preliminary pulses P1) are being output, thereby producing a seventh driving pulse P3*g*. Then, the second, fourth and sixth switch circuits 31*b*, 31*d* and 31*f* input the seventh driving pulse P3*g* to the second, fourth and sixth piezoelectric actuators 10*b*, 10*d* and 10*f*, respectively. Note that the $6N-4^{th}$ one of the preliminary pulses P1 and the $6N-4^{th}$ one of the discharge pulses P2 correspond to the "first one of the first driving pulses" as used herein, the $6N^{th}$ one of the preliminary pulses P1 and the $6N^{th}$ one of the discharge pulses P2 correspond to the "second one of the first driving pulses" as used herein, and the $_6N+2^{th}$ one of the preliminary pulses P1 and the $6N+2^{th}$ one of the discharge pulses P2 correspond to the "third one of the first driving pulses" as used herein. Thus, the switch circuits 31 selectively supply a driving pulse including the preliminary pulse P1 and the discharge pulse P2 in this order and a driving pulse including the discharge pulse P2 to the piezoelectric actuators 10.

Figure 26:
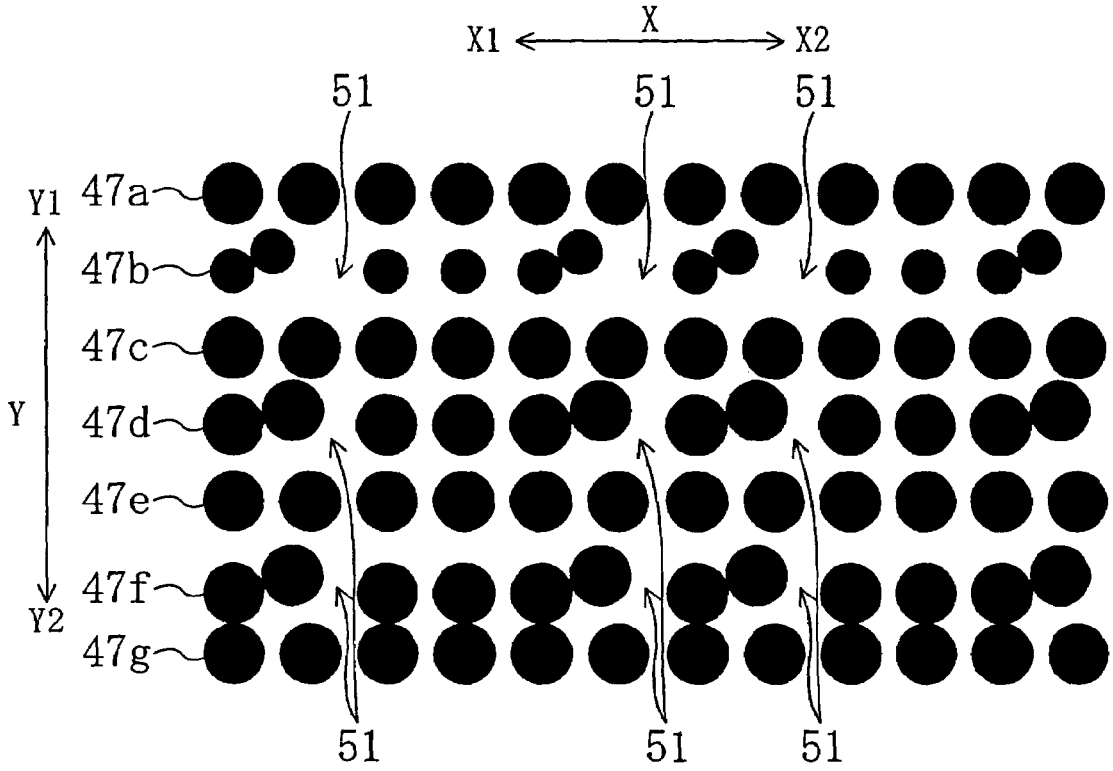
FIG. 26 is a diagram illustrating an ink dot pattern formed in an actual recording operation.

Thus, as illustrated in FIG. 26, the landing positions of the $6N-4^{th}$ and $6N^{th}$ ones of the second, fourth and sixth ink dots 47*b*, 47*d* and 47*f* are shifted in the Y1 direction from those of the other ones of the second, fourth and sixth ink dots 47*b*, 47*d* and 47*f*. In other words, the shifting of the landing position of the ink dot 47 in the Y direction is not done periodically.

Moreover, when the discharge pulse P2 is input after the preliminary pulse P1 is input to the piezoelectric actuator 10, the discharging velocity of the ink droplet discharged from the nozzle 2 may increase. Therefore, the landing positions of the $6N-4^{th}$ and $6N^{th}$ ones of the second, fourth and sixth ink dots 47*b*, 47*d* and 47*f* are shifted to the left (in the X1 direction). Thus, an image non-uniformity 51 occurs between the $6N-4^{th}$ ones of the second, fourth and sixth ink dots 47*b*, 47*d* and 47*f* and the $6N-3^{th}$ ones of the second, fourth and sixth ink dots 47*b*, 47*d* and 47*f*, and between the $6N^{th}$ ones of the second, fourth and sixth ink dots 47*b*, 47*d* and 47*f* and the $6N+1^{th}$ ones of the second, fourth and sixth ink dots 47*b*, 47*d* and 47*f*.

Figure 27:
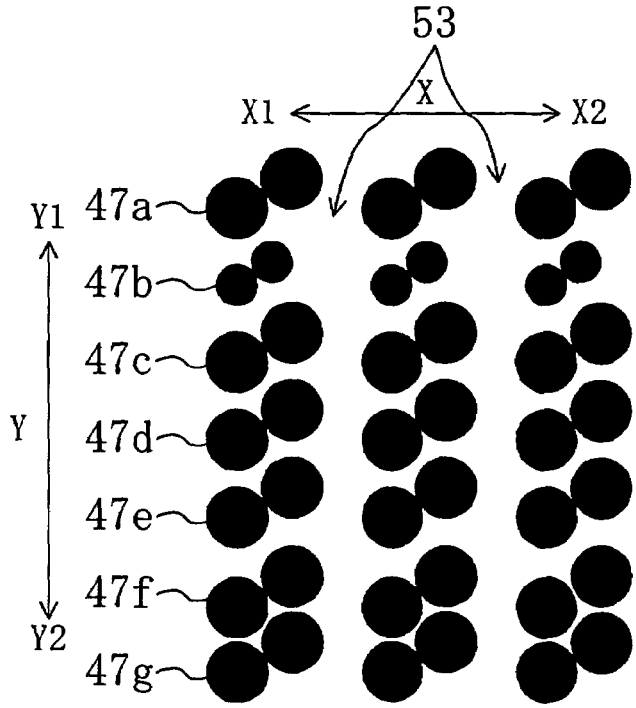
FIG. 27 is a diagram illustrating an ink dot pattern.
Figure 28:
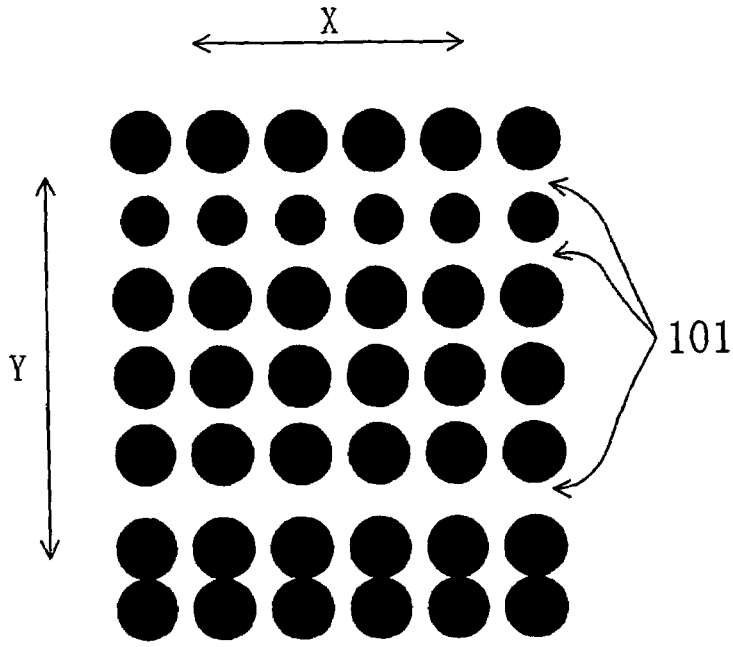
FIG. 28 is a diagram illustrating an ink dot pattern formed with a conventional technique.
Figure 29:
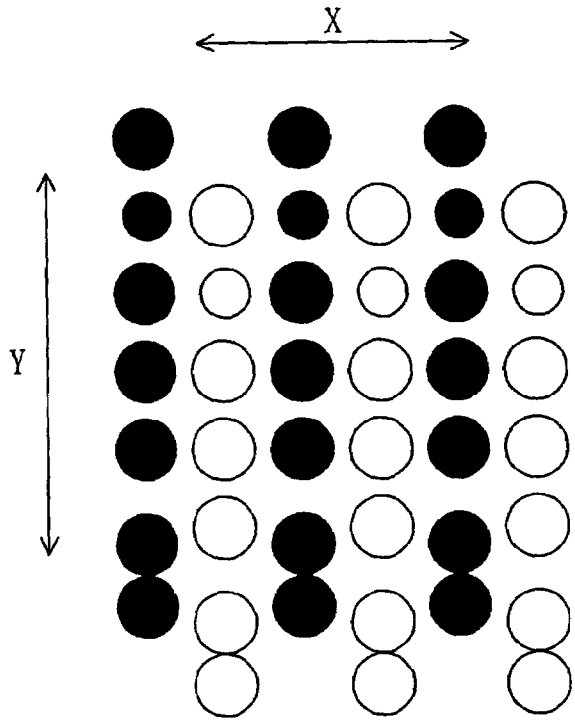
FIG. 29 is a diagram illustrating an ink dot pattern formed with a conventional technique.

If the first to seventh switch circuits 31*a*, 31*b*, 31*c*, 31*d*, 31*e*, 31*f* and 31*g* are turned OFF while the $2N-1^{th}$ preliminary pulse P1 is being output, the landing positions of the $2N^{th}$ ones of the first to seventh ink dots 47*a*, 47*b*, 47*c*, 47*d*, 47*e*, 47*f* and 47*g* are shifted in the Y1 direction from those of the $2N-1^{th}$ ones of the first to seventh ink dots 47*a*, 47*b*, 47*c*, 47*d*, 47*e*, 47*f* and 47*g*, as illustrated in FIG. 27.

Moreover, when the discharge pulse P2 is input after the preliminary pulse P1 is input to the piezoelectric actuator 10, the discharging velocity of the ink droplet discharged from the nozzle 2 may increase. Thus, an image non-uniformity 53 extending in the secondary scanning direction Y occurs between the $2N^{th}$ ones of the first to seventh ink dots 47*a*, 47*b*, 47*c*, 47*d*, 47*e*, 47*f* and 47*g* and the $2N+1^{th}$ ones of the first to seventh ink dots 47*a*, 47*b*, 47*c*, 47*d*, 47*e*, 47*f* and 47*g*. Furthermore, the image non-uniformities 53 extending in the secondary scanning direction Y occur at regular intervals.

According to the present embodiment, for the second, fourth and sixth piezoelectric actuators 10*b*, 10*d* and 10*f*, the interval between the start of the $6N-4^{th}$ discharge pulse P2 and that of the $6N^{th}$ discharge pulse P2 is different from the interval between the start of the $6N^{th}$ discharge pulse P2 and that of the $6N+2^{th}$ discharge pulse P2, whereby the image non-uniformities 51 occur at irregular intervals with respect to the primary scanning direction X on the recording paper 41. Therefore, it is possible to prevent the image non-uniformities 51 from occurring at regular intervals with respect to the primary scanning direction X on the recording paper 41.

For the first, third, fifth and seventh piezoelectric actuators 10*a*, 10*c*, 10*e* and 10*g*, only the discharge pulse P2 is input thereto as the driving pulse P3, whereby the discharging velocity of the ink droplets discharged from the first, third, fifth and seventh nozzles 2*a*, 2*c*, 2*e* and 2*g* does not change. Therefore, the landing positions of the first, third, fifth and seventh ink dots 47*a*, 47*c*, 47*e* and 47*g* are not shifted with respect to the primary scanning direction X. Thus, it is possible to prevent an image non-uniformity extending in the secondary scanning direction Y from occurring between the $6N-4^{th}$ ones of the first to seventh ink dots 47*a*, 47*b*, 47*c*, 47*d*, 47*e*, 47*f* and 47*g* and the $6N-3^{th}$ ones of the first to seventh ink dots 47*a*, 47*b*, 47*c*, 47*d*, 47*e*, 47*f* and 47*g*, or between the $6N^{th}$ ones of the first to seventh ink dots 47*a*, 47*b*, 47*c*, 47*d*, 47*e*, 47*f* and 47*g* and the $6N+1^{th}$ ones of the first to seventh ink dots 47*a*, 47*b*, 47*c*, 47*d*, 47*e*, 47*f* and 47*g*.

Note that while some switch circuits are turned OFF while the preliminary pulses P1 other than the $6N-4^{th}$ and $6N^{th}$ preliminary pulses P1 are being output in the present embodiment, the switch circuits may be turned OFF while any of the preliminary pulses P1 is being output as long as the image non-uniformities extending in the secondary scanning direction Y occur at irregular intervals on the recording paper 41.

Moreover, while only the discharge pulse P2 is input as the driving pulse P3 to the first, third, fifth and seventh piezoelectric actuators 10*a*, 10*c*, 10*e* and 10*g* in the present embodiment, the present invention is not limited to this as long as only the discharge pulse P2 is input as the driving pulse P3 to at least one of the first to seventh piezoelectric actuators 10*a*, 10*b*, 10*c*, 10*d*, 10*e*, 10*f* and 10*g*.

Alternative Embodiments

Note that while the vibration plate 11 functions also as a common electrode in the embodiments above, a vibration plate and a common electrode may alternatively be provided separately.

Moreover, while the piezoelectric element 13 is made of PZT in the embodiments above, it may alternatively be made of $PbTiO_3$, or the like. Moreover, the thickness of the piezoelectric element may be different from those shown in the embodiments above.

Moreover, while the vibration plate 11 is formed on the partition wall 7 in the embodiments above, the separate electrode 14 may alternatively be formed on the partition wall 7. In such a case, the vibration plate 11 is formed on the piezoelectric element 13.

Moreover, the material and the thickness of the vibration plate 11, the separate electrode 14, the nozzle plate 6 and the partition wall 7, etc., may be different from those shown in the embodiments above.

Moreover, while the rising waveforms P11 and P21 follow the falling waveforms P12 and P22 in the embodiments above, the falling waveforms P12 and P22 may alternatively follow the rising waveforms P11 and P21. Such a waveform is called a "push-pull" waveform.

Moreover, while the recording medium is the recording paper 41 in the embodiments above, it may alternatively be any other suitable recording medium.

Moreover, while seven nozzles 2, seven pressure chambers 4 and seven piezoelectric actuators 10 are arranged at a predetermined interval in the secondary scanning direction Y in the embodiments above, the number of these members arranged in the secondary scanning direction Y may alternatively be any other suitable number equal to or greater than two.

Moreover, while various patterns of the ink dots 47 are shown in the embodiments above, the present invention is not limited thereto as long as there is at least one ink dot 47 whose diameter or landing position is changed by inputting the preliminary pulse P1 and the discharge pulse P2 to the piezoelectric actuator 10 on the recording paper 41.

Furthermore, it is preferred that the ink dots 47 whose diameters or landing positions are changed by inputting the preliminary pulse P1 and the discharge pulse P2 to the piezoelectric actuators 10 are evenly distributed across the recording paper 41. Herein, "the ink dots 47 whose diameters or landing positions are changed being not evenly distributed across the recording paper 41" means, for example, that the ink dots 47 whose landing positions are changed are on the left half of the recording paper 41 while the ink dots 47 whose landing positions are not changed are on the right half of the recording paper 41, or that the landing positions of all of the ink dots 47 on the recording paper 41 are changed.

Moreover, while the switch circuits 31 are configured so as to selectively supply a driving pulse including the preliminary pulse P1 and the discharge pulse P2 in this order and a driving pulse including the discharge pulse P2 in the embodiments above, they may alternatively be configured so as to selectively supply a plurality of kinds of driving pulses including these driving pulses.

Moreover, while the piezoelectric actuators 10 are used as the pressure application means for applying a pressure on the ink in the pressure chambers 4 in the embodiments above, the pressure application means is not limited to those of a piezoelectric type but may alternatively be those of a bubble-jet type.

INDUSTRIAL APPLICABILITY

Thus, the present invention can suitably be used in printers for computers, facsimiles, copiers, etc.

What is claimed is:

1. An ink jet recording apparatus, comprising a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein:

the nozzles include at least a first nozzle and a second nozzle that are arranged in a direction perpendicular to a relative movement direction in which the head assembly section is relatively moved with respect to the recording medium while discharging ink;

the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse; and the driving pulse supply means supplies the first driving pulse to the pressure application means corresponding to the first nozzle while supplying the second driving pulse to the pressure application means corresponding to the second nozzle, so that a direction in which the ink droplet is discharged from the first nozzle is different from a direction in which the ink droplet is discharged from the second nozzle.

2. The ink jet recording apparatus of claim 1, wherein where the driving pulse supply means supplies at least three first driving pulses, an interval between the first one of the first driving pulses and the second one of the first driving pulses is different from that between the second one of the first driving pulses and the third one of the first driving pulses.

3. The ink jet recording apparatus of claim 1, wherein:

the ink jet recording apparatus further comprises reference pulse generation means for generating a reference pulse for driving the pressure application means;

the reference pulse includes the preliminary pulse and the discharge pulse; and the driving pulse supply means produces one of the first and second driving pulses from the preliminary pulse and the discharge pulse generated by the reference pulse generation means, and supplies the produced pulse to the pressure application means.

4. The ink jet recording apparatus of claim 1, wherein an interval between a start of the preliminary pulse and a start of the discharge pulse in the first driving pulse is less than or equal to twice a Helmholtz period of the head assembly section.

5. The ink jet recording apparatus of claim 1, wherein the driving pulse supply means selectively supplies, in addition to the first driving pulse and the second driving pulse, a third driving pulse including the preliminary pulse.

6. The ink jet recording apparatus of claim 1, wherein each of the pressure application means is a piezoelectric element.

7. An ink jet recording apparatus, comprising a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein:

the nozzles include a plurality of nozzles that are arranged in a direction perpendicular to a relative movement direction in which the head assembly section is relatively moved with respect to the recording medium while discharging ink;

the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse; and the driving pulse supply means supplies the first driving pulse to the pressure application means corresponding at least one of the plurality of nozzles in a predetermined printing period while supplying the second driving pulse thereto in a printing period different from the predetermined printing period, so that a direction in which the ink droplet is discharged from the nozzle by supplying the first driving pulse to the pressure application means is different from a direction in which the ink droplet is discharged from the nozzle by supplying the second driving pulse thereto.

8. The ink jet recording apparatus of claim 7, wherein:

the ink jet recording apparatus further comprises reference pulse generation means for generating a reference pulse including a first reference pulse and a second reference pulse, the first reference pulse including the preliminary pulse and the discharge pulse in this order, and the second reference pulse including the discharge pulse; and the driving pulse supply means supplies, to the pressure application means, the reference pulse generated by the reference pulse generation means as the driving pulse.

9. The ink jet recording apparatus of claim 8, wherein a waveform of the discharge pulse of the first reference pulse and that of the discharge pulse of the second reference pulse are different from each other.

10. The ink jet recording apparatus of claim 7, wherein where the driving pulse supply means supplies at least three first driving pulses, an interval between the first one of the first driving pulses and the second one of the first driving pulses is different from that between the second one of the first driving pulses and the third one of the first driving pulses.

11. The ink jet recording apparatus of claim 7, wherein:

the ink jet recording apparatus further comprises reference pulse generation means for generating a reference pulse for driving the pressure application means;

the reference pulse includes the preliminary pulse and the discharge pulse; and the driving pulse supply means produces one of the first and second driving pulses from the preliminary pulse and the discharge pulse generated by the reference pulse generation means, and supplies the produced pulse to the pressure application means.

12. The ink jet recording apparatus of claim 7, wherein an interval between a start of the preliminary pulse and a start of the discharge pulse in the first driving pulse is less than or equal to twice a Helmholtz period of the head assembly section.

13. The ink jet recording apparatus of claim 7, wherein the driving pulse supply means selectively supplies, in addition to the first driving pulse and the second driving pulse, a third driving pulse including the preliminary pulse.

14. The ink jet recording apparatus of claim 7, wherein each of the pressure application means is a piezoelectric element.

15. An ink jet recording apparatus, comprising a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein:

the nozzles include at least a first nozzle and a second nozzle that are arranged in a direction perpendicular to a relative movement direction in which the head assembly section is relatively moved with respect to the recording medium while discharging ink;

when the same driving pulse is supplied to the pressure application means corresponding to the first nozzle and to the pressure application means corresponding to the second nozzle, an ink droplet discharged through the second nozzle forms an ink dot whose diameter is a predetermined reference diameter and whose landing position is a reference landing position on the recording medium, while an ink droplet discharged through the first nozzle forms an ink dot whose diameter is different from the predetermined reference diameter and/or whose landing position is shifted from the reference landing position; and the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse, wherein the first driving pulse is supplied to the pressure application means corresponding to the first nozzle while the second driving pulse is supplied to the pressure application means corresponding to the second nozzle.

16. The ink jet recording apparatus of claim 15, wherein:

the ink jet recording apparatus further comprises reference pulse generation means for generating a reference pulse for driving the pressure application means;

the reference pulse includes the preliminary pulse and the discharge pulse; and the driving pulse supply means produces one of the first and second driving pulses from the preliminary pulse and the discharge pulse generated by the reference pulse generation means, and supplies the produced pulse to the pressure application means.

17. The ink jet recording apparatus of claim 15, wherein an amplitude of the preliminary pulse is equal to that of the discharge pulse, and a pulse width of the preliminary pulse is 1/40 to 1/5 of a Helmholtz period of the head assembly section.

18. The ink jet recording apparatus of claim 15, wherein an interval between a start of the preliminary pulse and a start of the discharge pulse in the first driving pulse is less than or equal to twice a Helmholtz period of the head assembly section.

19. The ink jet recording apparatus of claim 15, wherein a landing position of a first ink dot that is formed by supplying the second driving pulse to the pressure application means and that of a second ink dot that is formed by supplying the first driving pulse to the pressure application means are different from each other with respect to the direction perpendicular to the relative movement direction.

20. The ink jet recording apparatus of claim 19, wherein when the preliminary pulse is supplied to the pressure application means, a cross section, perpendicular to the relative movement direction, of the ink meniscus in the tip portion of the nozzle corresponding to the pressure application means is asymmetric about an axis of the nozzle.

21. The ink jet recording apparatus of claim 19, wherein each of the nozzles arranged in the direction perpendicular to the relative movement direction is shifted from a center of the pressure chamber that is communicated to the nozzle with respect to the direction perpendicular to the relative movement direction.

22. The ink jet recording apparatus of claim 19, wherein a cross section, perpendicular to the relative movement direction, of each of the nozzles arranged in the direction perpendicular to the relative movement direction is asymmetric about an axis of the nozzle.

23. The ink jet recording apparatus of claim 19, wherein a distance between a center of the first ink dot and a center of the second ink dot with respect to the direction perpendicular to the relative movement direction is less than or equal to ½ of a pitch of the ink dots.

24. The ink jet recording apparatus of claim 15, wherein the driving pulse supply means selectively supplies, in addition to the first driving pulse and the second driving pulse, a third driving pulse including the preliminary pulse application means is a piezoelectric element.

25. The ink jet recording apparatus of claim 15, wherein each of the pressure application means is a piezoelectric element.

26. An ink jet recording apparatus comprising a head assembly section provided with a plurality of nozzles and a plurality of pressure chambers storing ink therein and communicated respectively to the nozzles a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein:

the nozzles include at least a first nozzle and a second nozzle that are arranged in a direction perpendicular to a relative movement direction in which the head assembly section is relatively moved with respect to the recording medium while discharging ink;

the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse;

the driving pulse supply means supplies the first driving pulse to the pressure application means corresponding to the first nozzle while supplying the second driving pulse to the pressure application means corresponding to the second nozzle; and an amplitude of the preliminary pulse is equal to that of the discharge pulse, and a pulse width of the preliminary pulse is 1/40 to 1/5 of a Helmholtz period of the head assembly section.

27. An ink jet recording apparatus of claim 7, comprising a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein:

the nozzles include a plurality of nozzles that are arranged in a direction perpendicular to a relative movement direction in which the head assembly section is relatively moved with respect to the recording medium while discharging ink;

the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse;

the driving pulse supply means supplies the first driving pulse to the pressure application means corresponding at least one of the plurality of nozzles in a predetermined printing period while supplying the second driving pulse thereto in a printing period different from the predetermined printing period; and an amplitude of the preliminary pulse is equal to that of the discharge pulse, and a pulse width of the preliminary pulse is 1/40 to 1/5 of a Helmholtz period of the head assembly section.

28. An ink jet recording apparatus comprising a head assembly section provided with a plurality of nozzles and a plurality of pressure chambers storing ink therein and communicated respectively to the nozzles, a plurality of pressure application means for applying a pressure on the ink in the respective pressure chambers so as to discharge ink droplets through the nozzles onto a recording medium, and driving pulse supply means for supplying, to the pressure application means, a driving pulse for driving the pressure application means, wherein:

the nozzles include at least a first nozzle and a second nozzle that are arranged in a direction perpendicular to a relative movement direction in which the head assembly section is relatively moved with respect to the recording medium while discharging ink;

the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse;

the driving pulse supply means supplies the first driving pulse to the pressure application means corresponding to the first nozzle while supplying the second driving pulse to the pressure application means corresponding to the second nozzle; and a landing position of a first ink dot that is formed by supplying the second driving pulse to the pressure application means and that of a second ink dot that is formed by supplying the first driving pulse to the pressure application means are different from each other with respect to the direction perpendicular to the relative movement direction.

29. The ink jet recording apparatus of claim 28, wherein when the preliminary pulse is supplied to the pressure application means, a cross section, perpendicular to the relative movement direction, of the ink meniscus in the tip portion of the nozzle corresponding to the pressure application means is asymmetric about an axis of the nozzle.

30. The ink jet recording apparatus of claim 28, wherein each of the nozzles arranged in the direction perpendicular to the relative movement direction is shifted from a center of the pressure chamber that is communicated to the nozzle with respect to the direction perpendicular to the relative movement direction.

31. The ink jet recording apparatus of claim 28, wherein a cross section, perpendicular to the relative movement direction, of each of the nozzles arranged in the direction perpendicular to the relative movement direction is asymmetric about an axis of the nozzle.

32. The ink jet recording apparatus of claim 28, wherein a distance between a center of the first ink dot and a center of the second ink dot with respect to the direction perpendicular to the relative movement direction is less than or equal to ½ of a pitch of the ink dots.

33. An ink jet recording apparatus, comprising a head assembly section provided with a plurality of nozzles and a plurality of pressure chambers storing ink therein and communicated respectively to the nozzles, a plurality of pressure application means for applying a pressure on the ink to the respective pressure chambers so as to discharge ink droplets through the nozzles onto a recording medium, and driving pulse supply means for supplying, to the pressure application means, a driving pulse for driving the pressure application means, wherein:

the nozzles include a plurality of nozzles that are arranged in a direction perpendicular to a relative movement direction in which the head assembly section is relatively moved with respect to the recording medium while discharging ink;

the driving pulse supply means selectively supplies a first driving pulse and a second driving pulse, the first driving pulse including a preliminary pulse for vibrating an ink meniscus in a tip portion of the nozzle and a discharge pulse for discharging an ink droplet through the nozzle in this order, and the second driving pulse including the discharge pulse;

the driving pulse supply means supplies the first driving pulse to the pressure application means corresponding at least one of the plurality of nozzles in a predetermined printing period while supplying the second driving pulse thereto in a printing period different from the predetermined printing period; and a landing position of a first ink dot that is formed by supplying the second driving pulse to the pressure application means and that of a second ink dot that is formed by supplying the first driving pulse to the pressure application means are different from each other with respect to the direction perpendicular to the relative movement direction.

34. The ink jet recording apparatus of claim 33, wherein when the preliminary pulse is supplied to the pressure application means, a cross section, perpendicular to the relative movement direction, of the ink meniscus in the tip portion of the nozzle corresponding to the pressure application means is asymmetric about an axis of the nozzle.

35. The ink jet recording apparatus of claim 33, wherein each of the nozzles arranged in the direction perpendicular to the relative movement direction is shifted from a center of the pressure chamber that is communicated to the nozzle with respect to the direction perpendicular to the relative movement direction.

36. The ink jet recording apparatus of claim 33, wherein a cross section, perpendicular to the relative movement direction, of each of the nozzles arranged in the direction perpendicular to the relative movement direction is asymmetric about an axis of the nozzle.

37. The ink jet recording apparatus of claim 33, wherein a distance between a center of the first ink dot and a center of the second ink dot with respect to the direction perpendicular to the relative movement direction is less than or equal to ½ of a pitch of the ink dots.

* * * * *

UNITED STATES PATENT AND TRADEMARK OFFICE

CERTIFICATE OF CORRECTION

PATENT NO. : 6,969,138 B2
APPLICATION NO. : 10/634971
DATED : November 29, 2005
INVENTOR(S) : Kouji Ikeda et al.

It is certified that error appears in the above-identified patent and that said Letters Patent is hereby corrected as shown below:

Title Page

Item (56), References Cited; FOREIGN PATENT DOCUMENTS, insert the following:

| | | |
|---|---|---|
| --JP | 59176055 A | 10/1984 |
| JP | 04339660 A | 11/1992 |
| JP | 55090373 A | 07/1980 |
| JP | 11277744 A | 10/1999-- |

In the Claims:

Column 33

Line 24, Claim 24: delete “application means is a piezoelectric element”

Signed and Sealed this

Fourteenth Day of November, 2006

JON W. DUDAS
*Director of the United States Patent and Trademark Office*